US008344964B2

(12) United States Patent
Ikawa et al.

(10) Patent No.: US 8,344,964 B2
(45) Date of Patent: Jan. 1, 2013

(54) ARTIFICIAL MEDIUM

(75) Inventors: Koji Ikawa, Tokyo (JP); Masahide Koga, Tokyo (JP); Fuminori Watanabe, Tokyo (JP); Ryuta Sonoda, Tokyo (JP); Kazuhiko Niwano, Tokyo (JP)

(73) Assignee: Asahi Glass Company, Limited, Tokyo (JP)

( * ) Notice: Subject to any disclaimer, the term of this patent is extended or adjusted under 35 U.S.C. 154(b) by 209 days.

(21) Appl. No.: 12/805,946

(22) Filed: Aug. 25, 2010

(65) Prior Publication Data

US 2011/0102297 A1 May 5, 2011

Related U.S. Application Data

(63) Continuation of application No. PCT/JP2009/053459, filed on Feb. 25, 2009.

(30) Foreign Application Priority Data

Feb. 26, 2008 (JP) ..... P.2008-045070

(51) Int. Cl.
*H01Q 15/02* (2006.01)

(52) U.S. Cl. ..... 343/909; 343/700 MS; 343/824

(58) Field of Classification Search ..... 343/700 MS, 343/909, 824
See application file for complete search history.

(56) References Cited

U.S. PATENT DOCUMENTS 7,151,506 B2 * 12/2006 Knowles et al. ..... 343/909
7,209,083 B2 * 4/2007 Fujishima et al. ..... 343/700 MS
7,253,780 B2 * 8/2007 Sievenpiper ..... 343/745
7,705,782 B2 * 4/2010 Lee ..... 343/700 MS

FOREIGN PATENT DOCUMENTS

JP 2006-245984 A 9/2006
JP 2007-256929 A 10/2007

OTHER PUBLICATIONS

Caloz et al., "Invited-Novel Microwave Devices and Structures Based on the Transmission Line Approach of Meta-Materials", IEEE MTT-S Digest, 2003, vol. 1, pp. 195-198.
Shelby et al., "Experimental Verification of a Negative Index of Refraction", Science, 2001, vol. 292, pp. 77-79.
Dolling et al., "Low-loss Negative-Index Metamaterial at Telecommunication Wavelengths", Optics Letters, 2006, vol. 31(12), pp. 1800-1802.

(Continued)

*Primary Examiner* — Hoang V Nguyen
(74) *Attorney, Agent, or Firm* — Foley & Lardner LLP

(57) ABSTRACT

An artificial medium includes: a dielectric layer having a front surface and a back surface; a plurality of first grid lines respectively formed on the front surface and the back surface and extending in a first direction and a plurality of second grid lines extending in a second direction different from the first direction; and electrically conductive elements respectively formed on the front surface and the back surface of the dielectric layer and located in areas where the first grid lines intersect the second grid lines, wherein when an electromagnetic wave propagated in the direction of the thickness of the dielectric layer is incident, a current excited by the electromagnetic wave is increased in a prescribed operating frequency and a current loop is formed in a plane parallel to the direction of the thickness.

11 Claims, 18 Drawing Sheets

OTHER PUBLICATIONS

Rahmat-Samii, Y., "The Marvels of Electromagnetic Band Gap (EBG) Structures; Novel Microwave and Optical Applications", Proceedings of the 2003 SBMO/IEEE MTT-S International Microwave and Optoelectronics Conference, 2003, pp. 265-275.

Weily et al., "Antennas Based on 2-D and 3-D Electromagnetic Bandgap Materials", IEEE Antennas and Propagation Society International Symposium 2003 Digest, 2003, vol. 4. pp. 847-850.

Caloz et al., "A Novel Multilayer Super-Compact Inharmonic Photonic Band-Gap(PBG) Structure for Microstrip Applications", Proceedings of APMC, 2001, pp. 651-654.

Nicolson et al., "Measurement of the Intrinsic Properties of Materials by Time-Domain Techniques", IEEE Transaction on Instrumentation and Measurement, 1970, vol. IM-19 (4), pp. 377-382.

Baker-Jarvis et al., "Improved Technique for Determining Complex Permittivity with the Transmission/Reflection Method", IEEE Transactions on Microwave Theory and Techniques, 1990, vol. 38(8), pp. 1096-1103.

Weir, William B., "Automatic Measurement of Complex Dielectric Constant and Permeability at Microwave Frequencies", Proceedings of the IEEE, 1974, vol. 62(1), pp. 33-36.

International Search Report received in Jun. 9, 2009 for International Application No. PCT/JP2009/053459 (2 pgs).

Dolling et al., "From 'magnetic atoms' to low-loss negative-index metamaterials at telecommunication wavelengths," Lasers and Electro-Optics and 2006 Quantum Electronics and Laser Science Conference, CLEO/QELS, 2006, Conference on IEEE, May 21, 2006, 1-2, XP031395366.

Oh et al., "Design of Negative Index Metamaterials in Optical Communication range," Infrared and Millimeter Waves, 2007, and the 2007 15$^{th}$ International Conference on Terahertz Electronics, IRMMW-THX, Joint 32$^{nd}$ International Conference on IEEE, Sep. 2, 2007, 344-345.

* cited by examiner

ARTIFICIAL MEDIUM

TECHNICAL FIELD

The present invention relates to an artificial medium and more particularly to an artificial left-handed system medium.

BACKGROUND ART

An artificial medium in which both an effective relative dielectric constant and an effective relative magnetic permeability are negative, what is called a "left-handed system medium" is a substance having a negative refractive index that does not exist in the natural world and shows a unique phenomenon in which a property of a wave motion is inverted to that of an ordinary substance, what is called a "right-handed system medium". For instance, the inverted phenomenon includes a symbol (a negative refractive index) of an angle of refraction in the Snell's law, a direction of wave number vector (backward wave), the Doppler effect or the like. As an expansion of this conception, a matched zero refractive index medium in which both the effective relative dielectric constant and the effective relative magnetic permeability are zero also attracts a high attention. Thus, in various fields, studies are made for producing various kinds of highly developed devices and instruments by using characteristics of the left-handed system medium. For instance, in an optical field, studies are made for realizing a high resolution exceeding a diffraction limit for a lens by using the artificial medium. Further, in a field of microwave and millimeter-wave, studies are made for miniaturizing an antenna or achieving a high performance of an antenna by using the artificial medium.

It is known that a technique for forming the artificial left-handed system medium is roughly classified into two kinds. One of them is a technique using a transmission line and, for instance, non-patent literature 1 may be exemplified.

In this technique, an already established transmission theory and a right-handed system line realized by the theory are expanded in quality and a discrete inductor and a capacitor are inserted into the line to realize a left-handed system line. A great feature of this technique is to essentially show wide band characteristics. This technique is applied to an antenna supposed to be connected to a circuit element such as a filter or the transmission line and operates to an electromagnetic wave transmitted in space. Therefore, in this technique, it is extremely difficult to apply the transmission line type left-handed system medium to, for instance, a lens.

As compared therewith, as the left-handed system medium that can operate to the electromagnetic wave transmitted in the space, non-patent literature 2 may be exemplified.

This left-handed system medium has a structure having a split ring resonator combined with a conductor strip. Accordingly, the left-handed system medium has a restriction in principle that a conductor surface of the split ring resonator needs to be formed in parallel with the transmitting direction of an electromagnetic wave. As a result, the left-handed system medium has a demerit that production processes are extremely complicated.

As a structure of the left-handed system medium that can solve the above-described demerit and operate to the electromagnetic wave in the space, non-patent literature 3 may be exemplified. In this technique, the same patterns made of net shaped conductors are respectively arranged on front and back surfaces of a dielectric to realize the left-handed system medium.

Non-patent literature 1: C. Caloz And T. Itoh, "Novel microwave devices and structures based on transmission line approach of meta-materials" IEEE-MTT Int'l Symp., vol. 1 pp. 195-198, June 2003

Non-patent literature 2: R. A. Shelby, D. R. Smith, S. Schultz, "Experimental Verification of a Negative index of Refraction", Science 292, pp. 77-79 2001

Non-patent literature 3: Gunnar Dolling, Christian Enkrich, Martin Wegner, Costas M. Soukoulis, Stefan Linden, OPTICS LETTERS, Vol. 31, No. 12, 2006

DISCLOSURE OF THE INVENTION

Problem that the Invention is to Solve

However, the artificial medium disclosed in the above-described non-patent literature 3 is proposed and supposed to be used in a band of light and hardly used in the field of microwave and millimeter-wave, because the artificial medium disclosed in the non-patent literature 3 has only a narrow frequency area where the left-handed system medium is obtained and has a dependence on a polarized wave. Namely, when the artificial medium is applied to, for instance, to the field of the microwave or millimeter-wave, an effective relative dielectric constant and an effective relative magnetic permeability may possibly greatly change depending on the direction of an electric field of an incident electromagnetic wave. A field to which the artificial medium having such a dependence on a polarized wave is applied is extremely limited, so that the artificial medium is hardly applied to various uses. Therefore, a conventional artificial medium has a problem that the artificial medium is not applied to the field of the microwave or millimeter-wave.

The present invention is devised by considering the above-described problems and it is an object of the present invention to provide an artificial medium having characteristics as a left-handed system medium over a wide frequency band and less dependence on a polarized wave.

Means for Solving the Problem

According to the present invention, there is provided an artificial medium including: a dielectric layer; and first and second conductive patterns that are oppositely disposed across the dielectric layer, wherein: when an electromagnetic wave propagated in the direction of the thickness of the dielectric layer is incident, a current excited by the electromagnetic wave is increased in a prescribed operating frequency and a current loop is formed in a plane parallel to the direction of the thickness; the first and second conductive patterns including electrically conductive elements, a plurality of first grid lines extending in a first direction and a plurality of second grid lines extending in a second direction different from the first direction; and the electrically conductive elements are respectively located in areas where the first grid lines intersect the second grid lines.

Advantage of the Invention

According to the present invention, it is possible to provide an artificial medium having characteristics as a left-handed system medium over a wide frequency band and less dependence on a polarized wave.

The artificial medium of the present invention can be used for, for instance, a lens antenna for high frequency, a radome for an antenna, a superstrate for an antenna a micro-resonator and transmitter for communication or the like.

BEST MODE FOR IMPLEMENTING THE INVENTION

Figure 1:
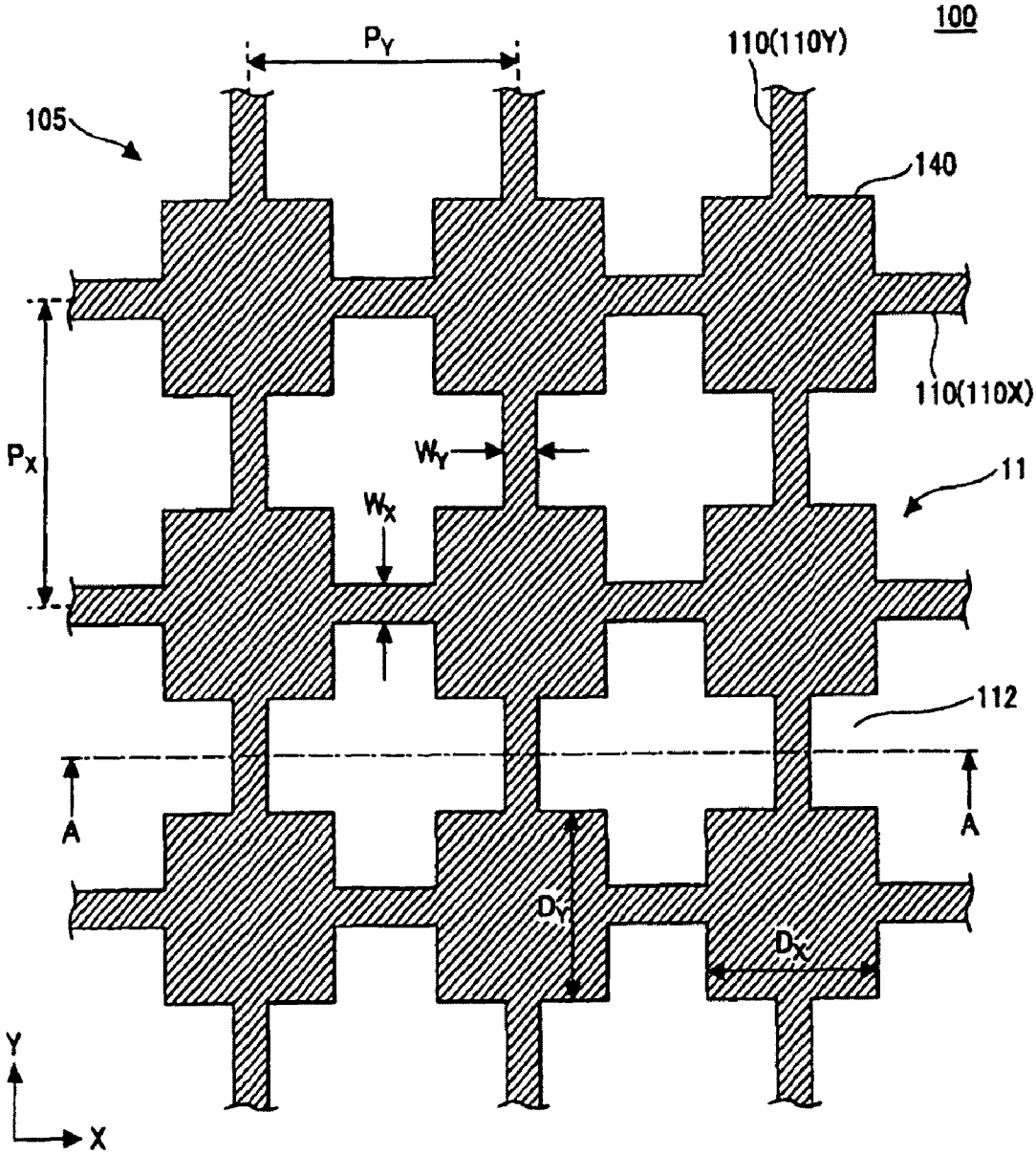
FIG. 1 is a top view of a first artificial medium of the present invention.

Now, an exemplary embodiment of the present invention will be described below by referring to the drawings.

(First Artificial Medium)

FIG. 1 shows a top view of a first artificial medium of the present invention. Further, FIG. 2 is a sectional view taken along a line A-A of the first artificial medium in FIG. 1.

Figure 2:
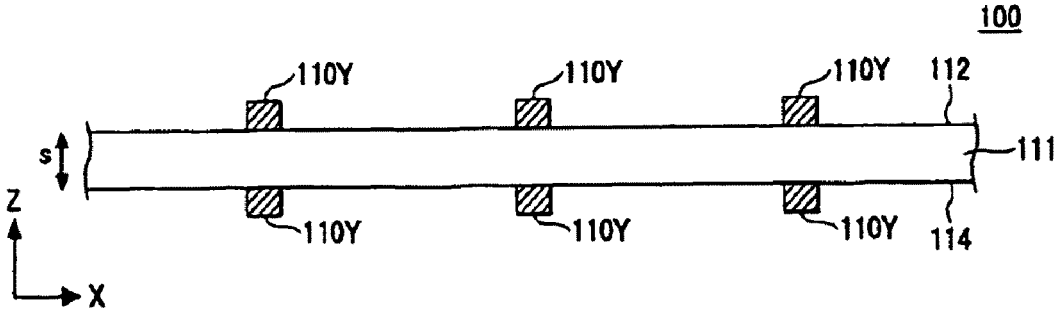
FIG. 2 is a sectional view taken along a line A-A of the artificial medium in FIG. 1.

As shown in FIGS. 1 and 2, the first artificial medium 100 according to the present invention includes a dielectric layer 111 having a front surface 112 and a back surface 114. On the front surface 112 and the back surface 114 of the dielectric layer 111, electrically conductive grid lines 110 and electrically conductive tiles 140 are formed. Here, patterns formed by the electrically conductive grid lines 110 and the electrically conductive tiles 140 are considered to be repeated patterns 105. The repeated patterns 105 formed respectively on the surfaces are substantially the same by viewing from the direction of the thickness of the dielectric layer 111. Further, the repeated patterns 105 respectively formed on the surfaces are arranged on the front surface 112 and the back surface 114 so that the repeated patterns substantially correspond mutually when the repeated patterns 105 respectively formed on the surfaces are viewed from the direction (a Z-direction in FIG. 2) parallel to the direction of the thickness of the dielectric layer 111. Namely, the repeated patterns 105 respectively provided on the surfaces are formed so as to be symmetrical by sandwiching the dielectric layer 111 between the repeated patterns.

Here, the "grid line" means a linear electric conductor arranged on the front surface (or the back surface) of the dielectric layer and having a substantially equal width. The "tile" means an electric conductor other than the "grid lines" arranged on an intersection of two "grid lines". In this application, the "tile" is also especially referred to an electrically conductive element. Here, to arrange the tile on an intersection of a plurality of grid lines does not mean to arrange the tile on the intersection of the grid lines and the grid lines are not present under the tile. That is, the grid lines and the tiles form the virtual same plane by viewing them from the direction of the thickness of the dielectric layer 111.

The grid lines 110 include a plurality of first grid lines 110X extending substantially in a first direction (an X-direction in the drawing) and a plurality of second grid lines 110Y extending substantially in a second direction (a Y-direction in the drawing). Further, the tiles 140 are respectively arranged on intersections of the first grid lines 110X and the second grid lines 110Y.

In FIG. 1, the first grid lines 110X are arranged at equal intervals of pitches $P_X$. Similarly, the second grid lines 110Y are arranged at equal intervals of pitches $P_Y$. Here, a relation of $P_X=P_Y$ is established. The widths of the first grid line 110X and the second grid line 110Y are respectively $W_X$ and $W_Y$. In an example shown in FIG. 1, a relation of $W_X=W_Y$ is established.

Here, in FIG. 1, the first grid lines 110X intersect orthogonally to the second grid lines 110Y. However, in the present invention, the first grid lines 110X do not necessarily intersect orthogonally to the second grid lines 110Y. Further, the first and second grid lines 110X and 110Y do not respectively necessarily need to be arranged at equal intervals. Further, even when the first and second grid lines 110X and 110Y are arranged at equal intervals, the pitches $P_X$ may be different from the pitches $P_Y$. Further, all the widths $W_X$ of the plurality of first grid lines 110X do not need to be the same widths $W_X$ and all the widths may be different, or the widths may be merely partly different or may have the same structures. Similarly, the above-described things may be applied to the widths $W_Y$ of the second grid lines 110Y. Further, the widths $W_X$ and $W_Y$ of the grid lines may be different.

Further, in the drawing, the tile 140 has a square form, a width $D_X$ in the X-direction is equal to a width $D_Y$ in the Y-direction. The tiles 140 are arranged on the front surface 112 and the back surface 114 of the dielectric layer 111. Each side of the square form of the tile 140 is substantially parallel to the extending direction of the first grid line 110X or the second grid line 110Y. Further, the tile 140 is arranged so that a center of gravity is overlapped on the intersection of the first grid line 110X and the second grid line 110Y.

The tiles 140 do not necessarily need to be arranged on all the intersections of the first grid lines 110X and the second grid lines 110Y. However, as illustrated below, the tiles 140 are more preferably arranged on all the intersections of the first grid lines 110X and the second grid lines 110Y. Further, the form of the tile 140 is not limited to the square form and various forms such as a rectangular form may be used.

Now, characteristics of the first artificial medium 100 according to the present invention which is constructed as described above will be described below by comparing them with characteristics of the artificial medium (refer it to as a "conventional artificial medium" hereinafter) described in the above-described non-patent literature 3.

Figure 3:
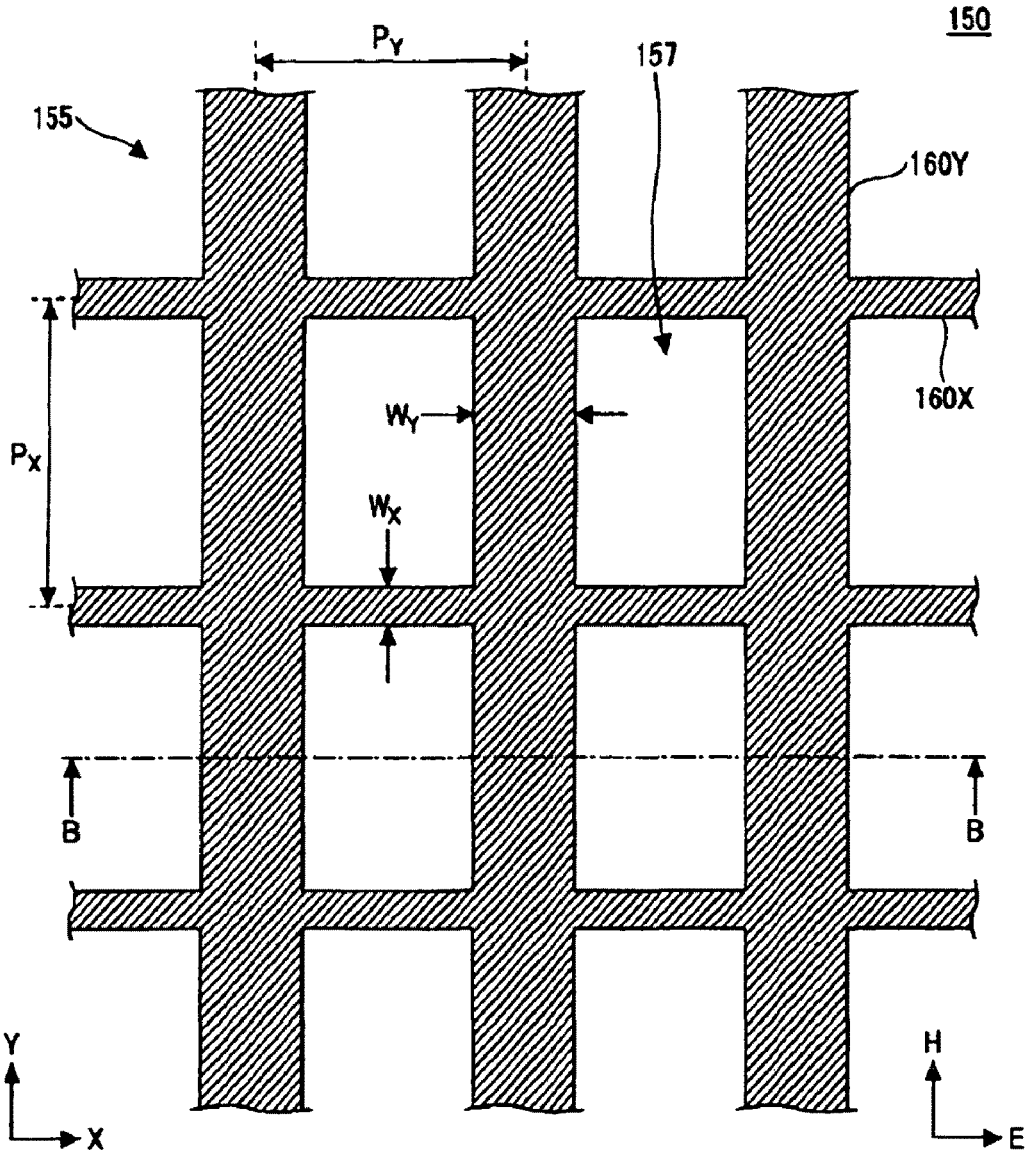
FIG. 3 is a top view of a conventional artificial medium.
Figure 4:
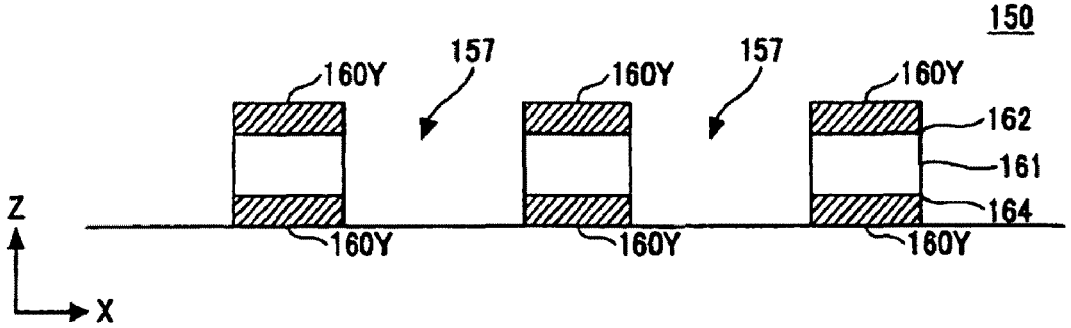
FIG. 4 is a sectional view taken along a line B-B of the conventional artificial medium in FIG. 3.

Initially, the structure of the conventional artificial medium is described. FIGS. 3 and 4 show a structure of the conventional artificial medium. FIG. 3 is a top view of the conventional artificial medium. FIG. 4 is a sectional view taken along a line B-B in FIG. 3.

The conventional artificial medium 150 includes a dielectric layer 161 having a front surface 162 and a back surface 164. On the front surface 162 and the back surface 164 of the conventional artificial medium 150, a plurality of grid lines are formed in the shape of a matrix. Here, a matrix shaped pattern is considered to be a repeated pattern 155. The conventional artificial medium 150 does not have "tiles" as in the present invention.

The pattern 155 includes a plurality of grid lines 160X (first grid lines) extending in an X-direction in FIG. 3 and a plurality of grid lines 160Y (second grid lines) extending in a Y-direction. The first grid lines 160X are arranged at equal intervals of pitches $P_X$. Similarly, the second grid lines 160Y are arranged at equal intervals of pitches $P_Y$. Here, a relation of $P_X=P_Y$ is established. The width $W_X$ of the first grid line 160X is smaller than the width $W_Y$ of the second grid line 160Y.

Here, the patterns 155 of the dielectric layer 161 have the same forms by viewing from the direction of thickness (see FIG. 4). Here, in the dielectric layer 161, openings 157 are provided in parts where both the first grid lines and the second grid lines are not arranged.

Now, a difference between the characteristics of the conventional artificial medium 150 and the characteristics of the first artificial medium 100 according to the present invention will be described below in accordance with the result of a simulation. The simulation is carried out by an FIT (Finite Integration Technique) method.

Parameters such as dimensions of elements respectively forming the artificial medium 100 and the artificial medium 150 used in the simulation are shown together in Table 1. In the Table 1, s designates the thickness of the dielectric layers 111 and 161 and t designates the thickness of the grid lines (and the tiles) respectively. Further, a relative magnetic permeability of the dielectric layers 111 and 161 is set to 1.0 and a relative dielectric constant is set to 3.4.

TABLE 1

| | $P_X$ (mm) | $P_Y$ (mm) | $D_X$ (mm) | $D_Y$ (mm) | $W_X$ (mm) | $W_Y$ (mm) | s (mm) | t (mm) |
|---|---|---|---|---|---|---|---|---|
| First artificial medium 100 according to the present invention | 6.0 | 6.0 | 4.0 | 4.0 | 1.0 | 1.0 | 0.6 | 0.018 |
| Conventional artificial medium 150 | 5.28 | 5.28 | — | — | 0.88 | 2.781 | 0.264 | 0.396 |

Figure 5:
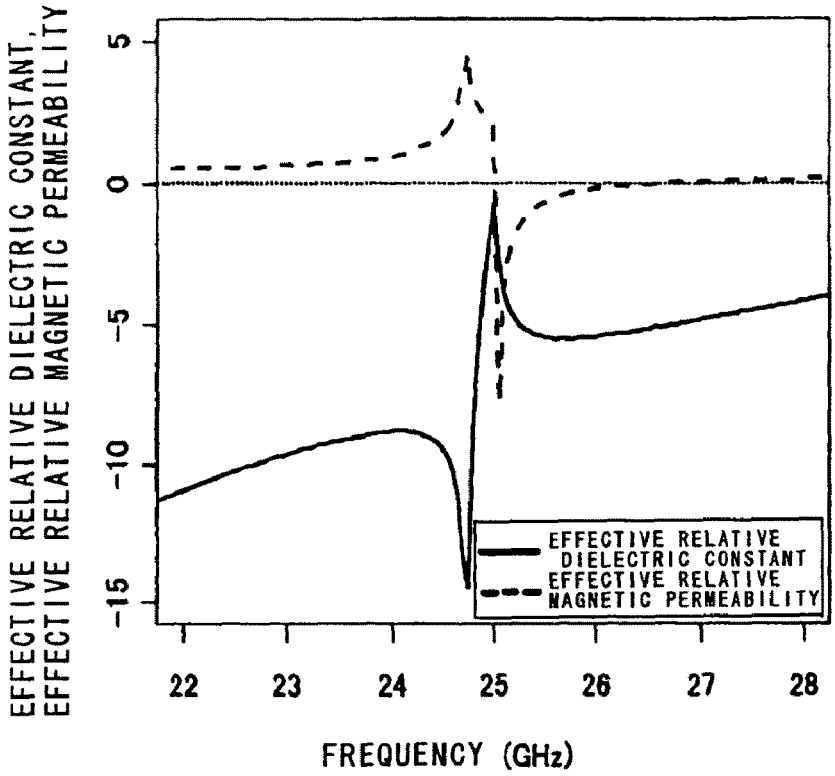
FIG. 5 is a graph showing frequency characteristics of an effective relative dielectric constant and an effective relative magnetic permeability in the conventional artificial medium.
Figure 6:
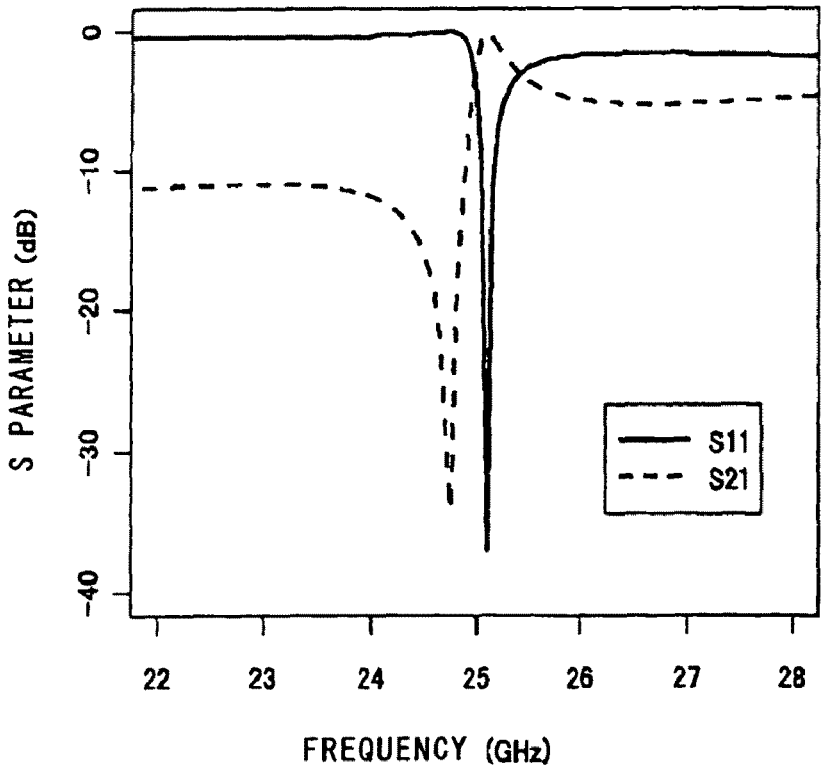
FIG. 6 is a graph showing frequency characteristics of an S parameter in the conventional artificial medium.
Figure 7:
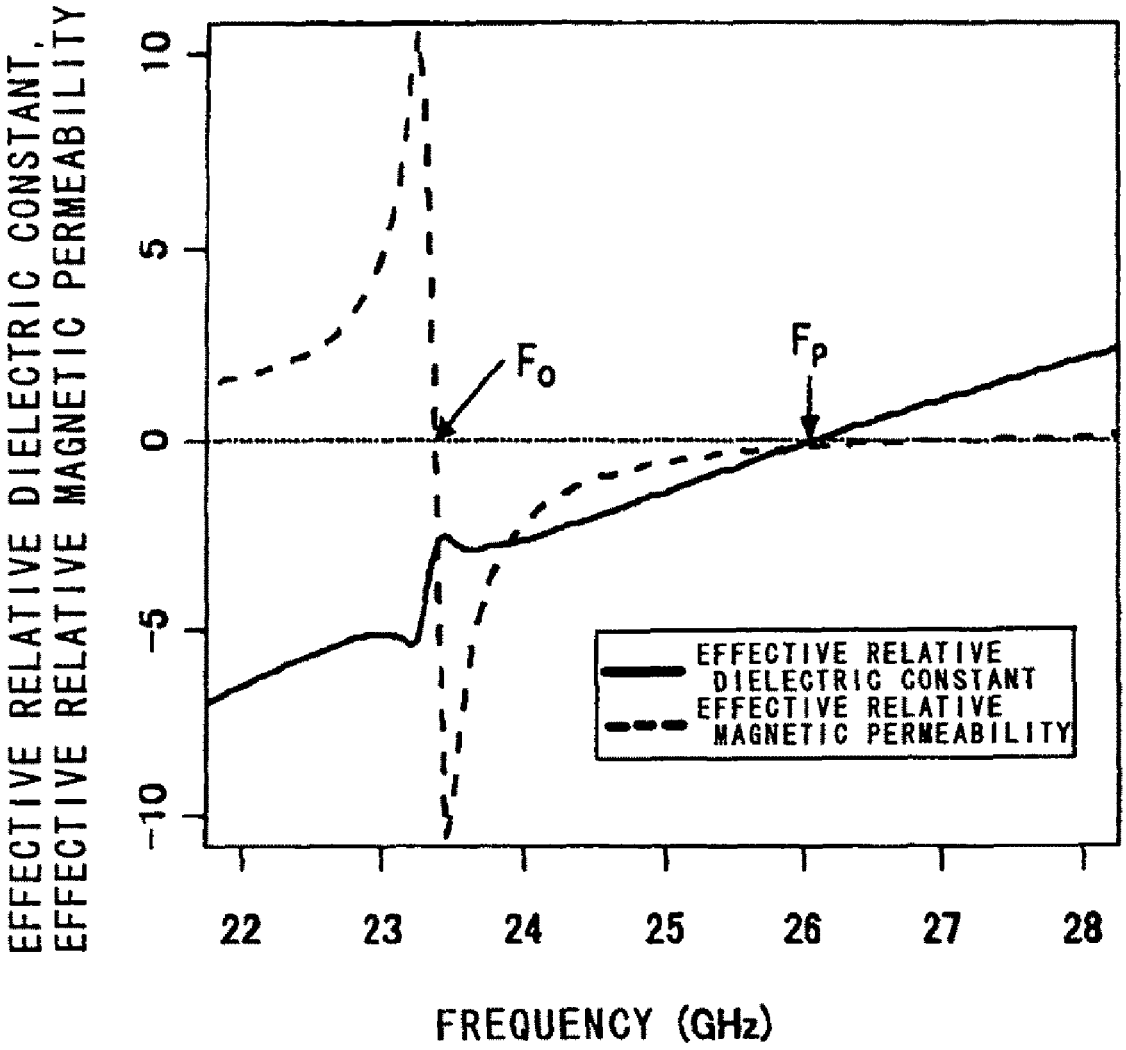
FIG. 7 is a graph showing frequency characteristics of an effective relative dielectric constant and an effective relative magnetic permeability in the first artificial medium of the present invention.
Figure 8:
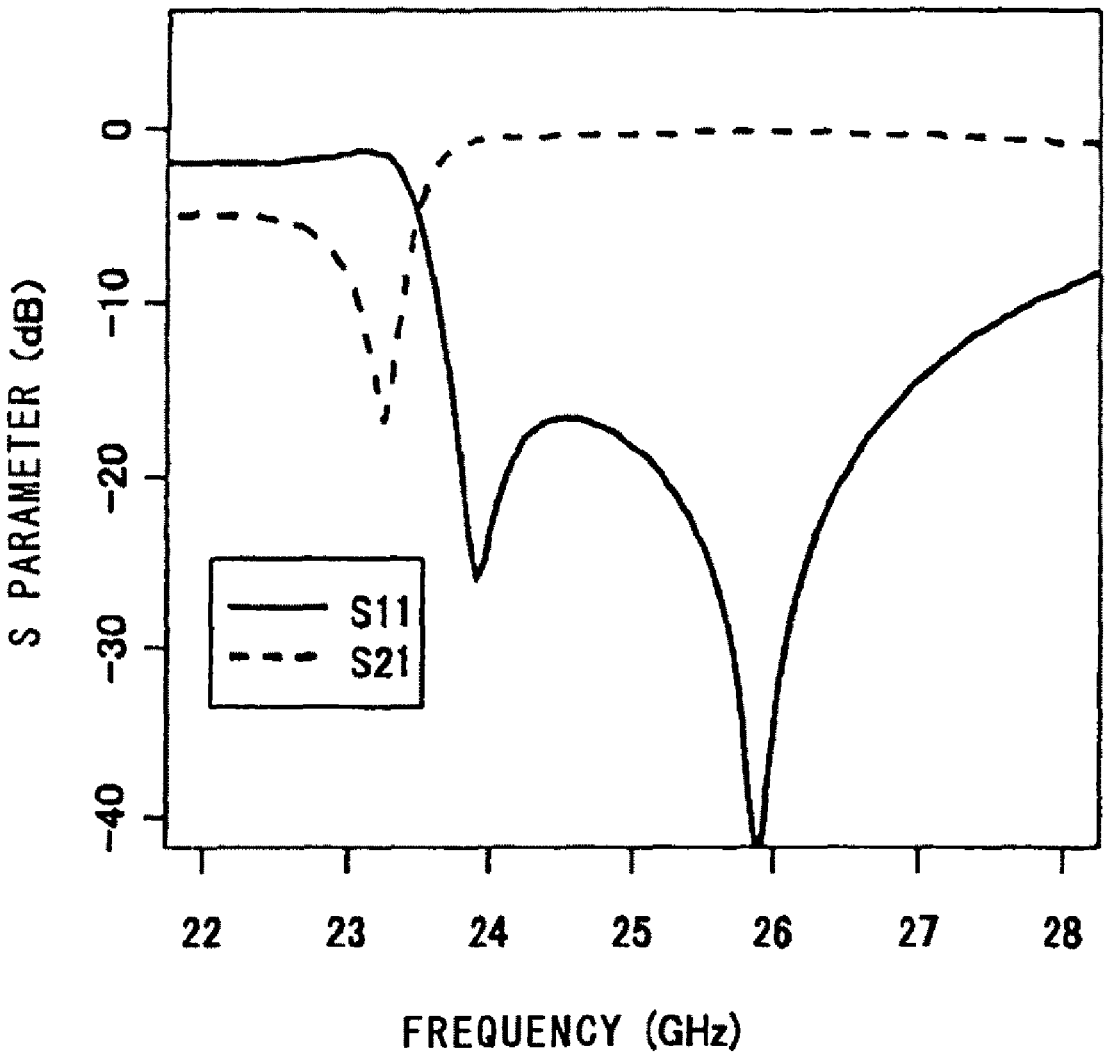
FIG. 8 is a graph showing frequency characteristics of an S parameter in the first artificial medium of the present invention.

FIGS. 5 to 8 show one examples of the results of a simulation of frequency characteristics in the first artificial medium 100 and the conventional artificial medium 150. FIG. 5 is a graph showing a dependence on frequency of an effective relative dielectric constant and an effective relative magnetic permeability in the conventional artificial medium. FIG. 6 is a graph showing a dependence on frequency of an S11 parameter and an S21 parameter in the conventional artificial medium. On the other hand, FIG. 7 is a graph showing a dependence on frequency of an effective relative dielectric constant and an effective relative magnetic permeability in the artificial medium 110 of the present invention. FIG. 8 is a graph showing a dependence on frequency of an S11 parameter and an S 21 parameter in the first artificial medium 100 of the present invention.

As shown in FIG. 5, in the conventional artificial medium 150, both the effective relative dielectric constant and the effective relative magnetic permeability are negative in a frequency area of about 25 GHz to about 26 GHz. Accordingly, it can be understood that the conventional artificial medium 150 obtains a left-handed system medium in the frequency band of about 25 GHz to about 26 GHz.

On the other hand, in the artificial medium 100 according to the present invention, as shown in FIG. 7, a magnetic resonance frequency Fo (a frequency in which an effective relative magnetic permeability is 0 between a positive peak and a negative peak of the effective relative magnetic permeability) is obtained in a frequency of about 23.5 GHz, and a plasma frequency Fp (a frequency in which an effective relative dielectric constant is 0) is obtained in a frequency of about 26 GHz. In the artificial medium 100 of the present invention, both the effective relative magnetic permeability and the effective relative dielectric constant are negative in a frequency area of about 23. 5 GHz to about 26 GHz. Accordingly, it is understood that the artificial medium 100 of the present invention obtains a left-handed system medium in the frequency area of about 23.5 GHz to about 26 GHz.

Here, as shown in FIG. 6, in the conventional artificial medium 150, it is recognized that an area where good transmission characteristics (S21 characteristics are −1 dB or higher) are obtained is limited to a position having a frequency of about 25 GHz. Therefore, in the conventional artificial medium 150, the frequency area where characteristics as the left-handed system medium are obtained is exceptionally limited. Namely, in the conventional artificial medium, a loss is large in other frequency area than 25 GHz, so that the conventional artificial medium cannot be properly used as an artificial medium for the field of a microwave or millimeter-wave.

As compared therewith, in the artificial medium 100 of the present invention, as shown in FIG. 8, the S21 characteristics are substantially 0 (zero) dB in a frequency area of about 24 GHz to about 28 GHz. Accordingly, the artificial medium 100 of the present invention can obtain good characteristics having less transmission loss over an extremely wider frequency area than the conventional artificial medium 150. Further, as shown in FIG. 7, in the artificial medium 100 of the present invention, both the effective relative magnetic permeability and the effective relative dielectric constant are 0 in 26 GHz. Accordingly, it is understood that the artificial medium 100 of the present invention achieves a matched zero refractive index medium in 26 GHz.

As described above, between the artificial medium of the present invention and the conventional artificial medium, a significant difference is recognized in a frequency band where the good left-handed system medium having less transmission loss is obtained. Further, the artificial medium of the present invention has a feature that the artificial medium of the present invention is lower in its dependence on a polarized wave than the conventional artificial medium. Now, this difference will be described below.

Figure 9:
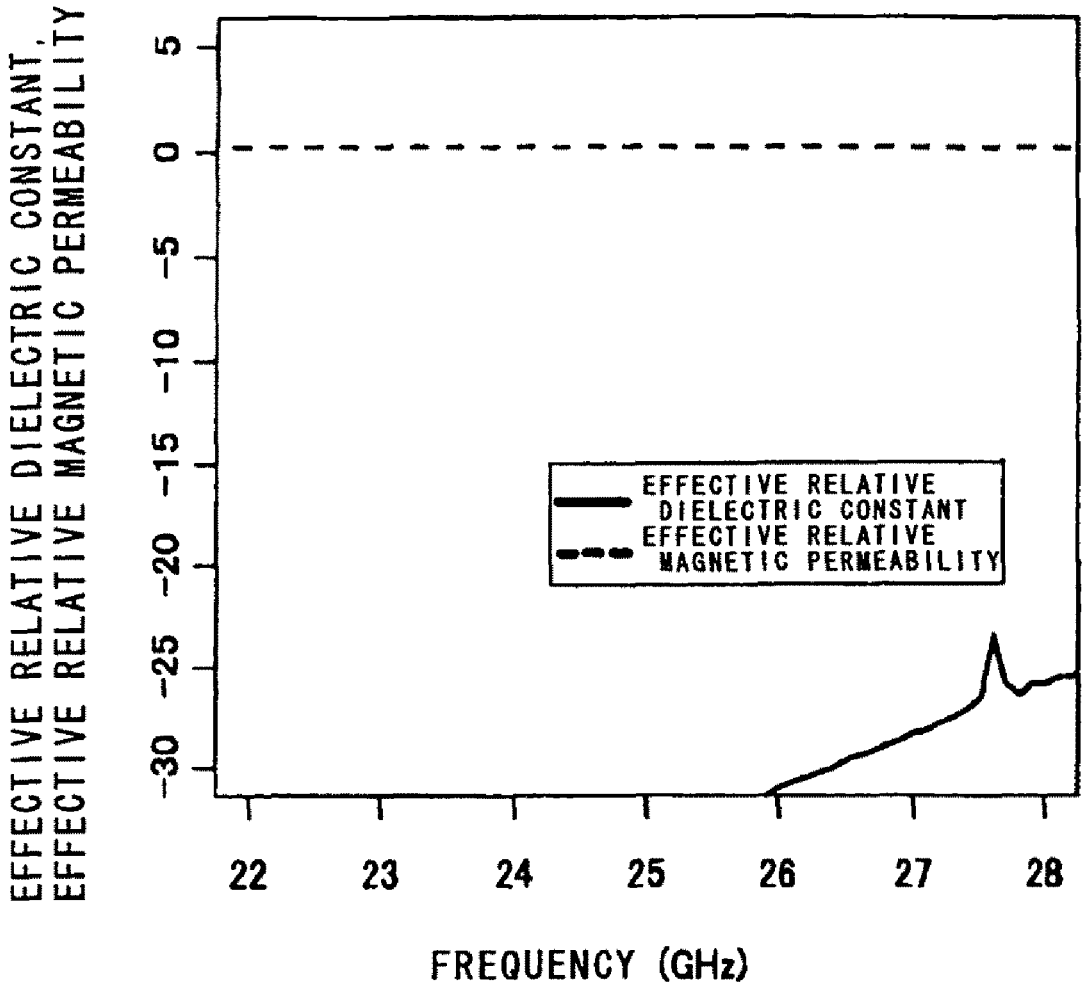
FIG. 9 is a graph showing the frequency characteristics of the effective relative dielectric constant and the effective relative magnetic permeability in the conventional artificial medium when a polarized wave is rotated by 90° in a simulation shown in FIG. 5.
Figure 10:
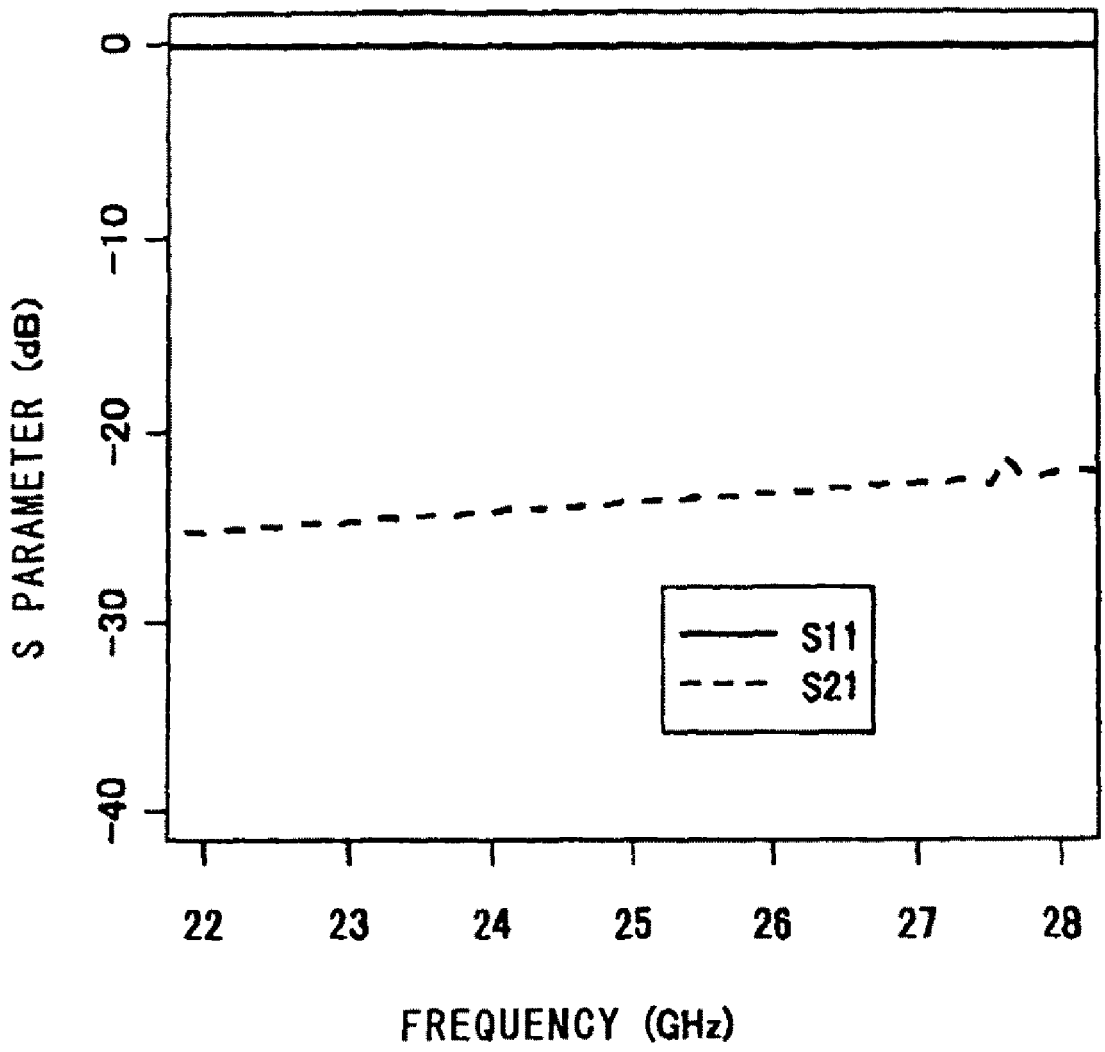
FIG. 10 is a graph showing the frequency characteristics of the S parameter in the conventional artificial medium when a polarized wave is rotated by 90° in a simulation shown in FIG. 6.

FIG. 9 and FIG. 10 show the results of a simulation when the polarized wave of an incident wave of the conventional artificial medium 150 is rotated by 90°. The results shown in FIG. 5 and FIG. 6 are obtained when the direction E of an electric field of an incident electromagnetic wave is parallel to an X-axis direction as shown in FIG. 3. As compared therewith, the results shown in FIG. 9 and FIG. 10 correspond to results obtained when the direction E of the electric field of the incident electromagnetic wave is parallel to a Y-axis direction.

As can be understood from FIG. 9 and FIG. 10, in the conventional artificial medium 150, when the polarized wave of the incident electromagnetic wave is changed by 90°, effective characteristics are not obtained.

Figure 11:
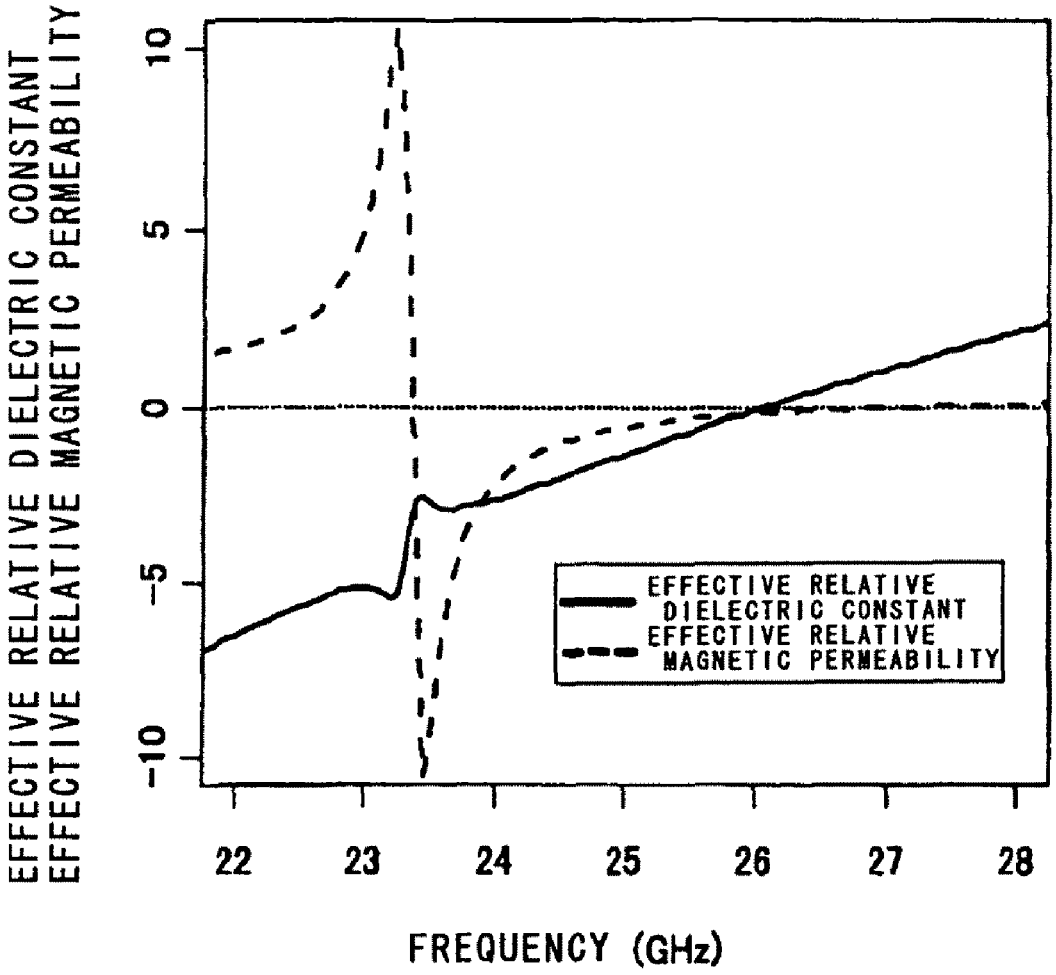
FIG. 11 is a graph showing the frequency characteristics of the effective relative dielectric constant and the effective relative magnetic permeability in the first artificial medium of the present invention when a polarized wave is rotated by 90° in a simulation shown in FIG. 7.
Figure 12:
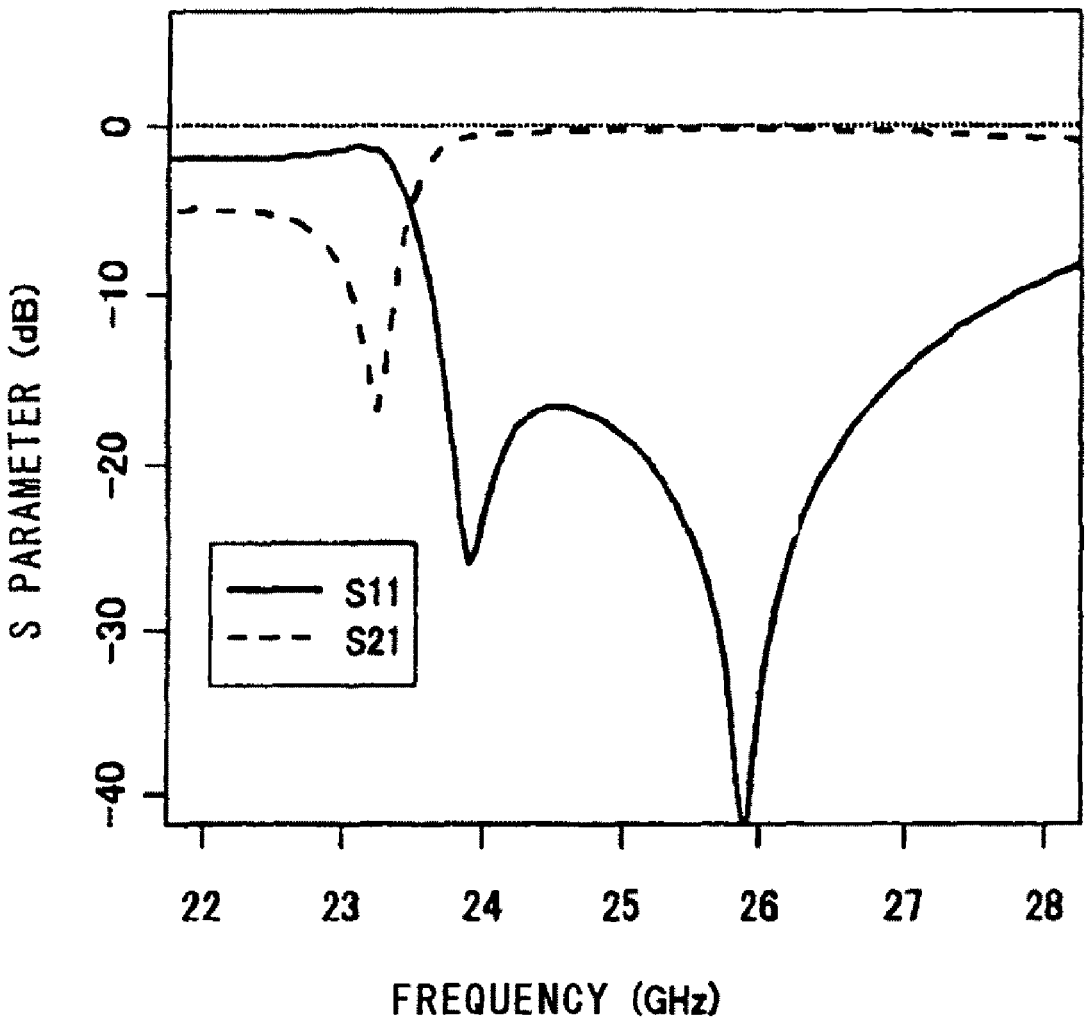
FIG. 12 is a graph showing the frequency characteristics of the S parameter in the first artificial medium of the present invention when a polarized wave is rotated by 90° in a simulation shown in FIG. 8.

FIG. 11 and FIG. 12 show the results of a simulation when an incident polarized wave of the artificial medium 100 of the present invention is rotated by 90°. It is understood from the comparison of these figures with the above-described FIG. 7 and FIG. 8, the characteristics of the artificial medium 100 of the present invention hardly depend on the direction of the polarized wave. Namely, it is recognized that the artificial medium of the present invention hardly has the dependence on the polarized wave and exhibits the characteristics as the left-handed system medium to any polarized wave.

As apparent from the above-described results of the simulations, the artificial medium of the present invention has the characteristics as the left-handed system medium over a wider frequency area and less dependence on the polarized wave than the conventional artificial medium.

(Second Artificial Medium)

Figure 13:
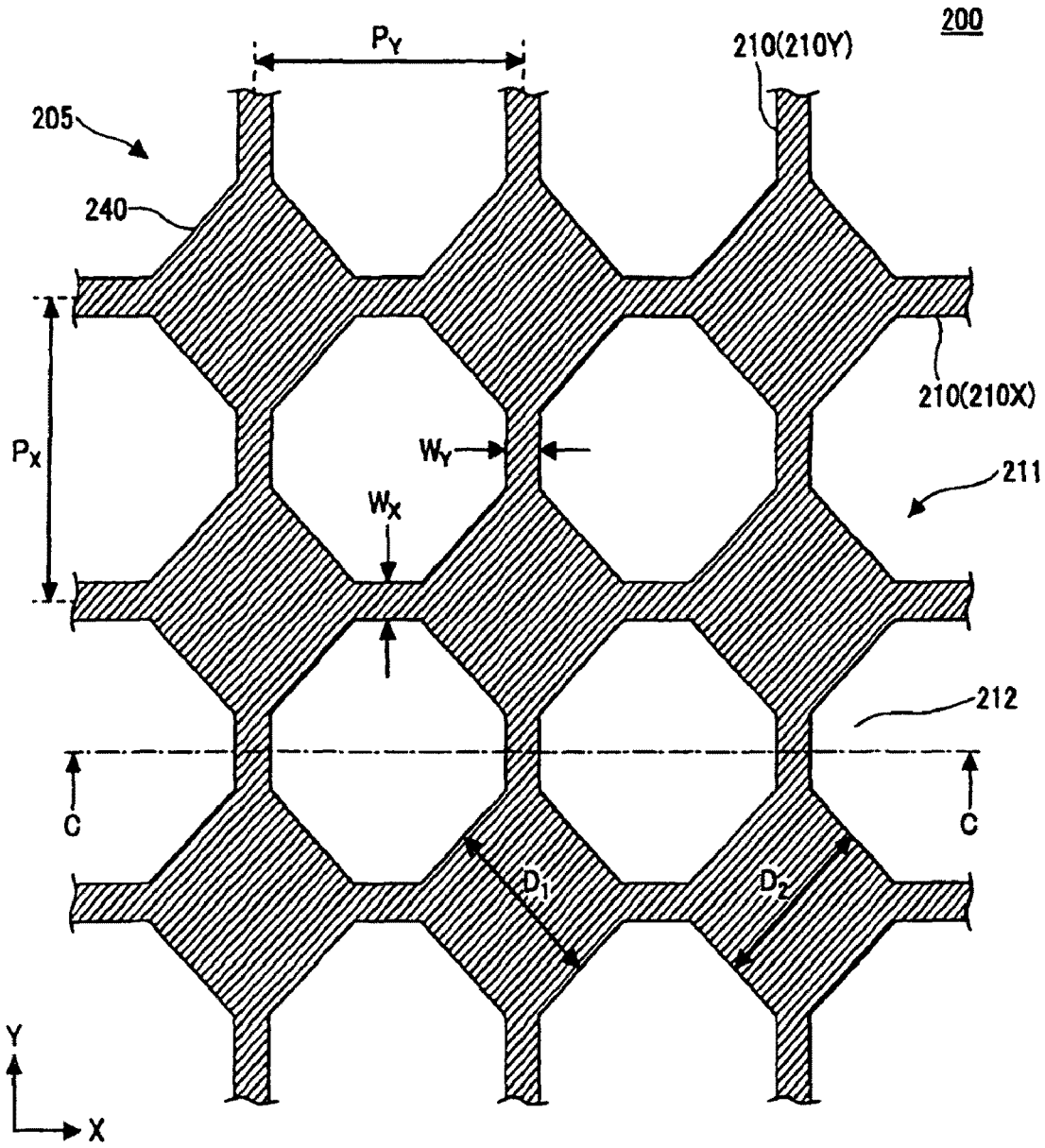
FIG. 13 is a top view of a second artificial medium of the present invention.
Figure 14:
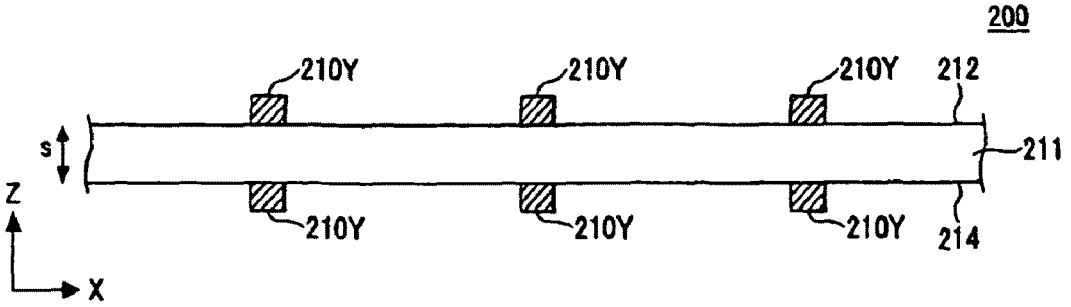
FIG. 14 is a sectional view taken along a line C-C of the artificial medium in FIG. 13.

Now, a second artificial medium according to the present invention will be described below. FIG. 13 shows a top view of a second artificial medium of the present invention. FIG. 14 is a sectional view taken along a line C-C of the second artificial medium shown in FIG. 13.

The second artificial medium 200 is basically formed like the above-described first artificial medium 100. The second artificial medium 200 according to the present invention includes a dielectric layer 211 having a front surface 212 and a back surface 214. On the front surface 212 and the back surface 214 of the dielectric layer 211, electrically conductive grid lines 210 and electrically conductive tiles 240 are formed. Here, patterns formed by the electrically conductive grid lines 210 and the electrically conductive tiles 240 are considered to be repeated patterns 205. The repeated patterns 205 formed respectively on the surfaces are substantially the same by viewing from the direction of the thickness of the dielectric layer 211. Further, the repeated patterns 205 respectively formed on the surfaces are arranged on the front surface 212 and the back surface 214 so that the repeated patterns substantially correspond mutually when the repeated patterns 205 respectively formed on the surfaces are viewed from the direction (a Z-direction in FIG. 14) parallel to the direction of the thickness of the dielectric layer 211. Namely, the repeated patterns 205 respectively provided on the surfaces are formed so as to be symmetrical with the dielectric layer 211 sandwiched between the repeated patterns.

However, in the second artificial medium 200, the orientation of the electrically conductive tiles 240 relative to the grid lines 210 is different from that in the first artificial medium 100. As shown in FIG. 13, the square shaped tiles 240 of the second artificial medium 200 are arranged on the front surface 212 (and the back surface 214) of the dielectric layer under a state that the square shaped tiles 240 of the second artificial medium are rotated by 45° with respect to the tiles. 140 of the first artificial medium 100. Accordingly, a minimum angle formed by each side of the tile 240 and an extending direction of a first grid line 210X (or a second grid line 210Y) is 45°. Here, the "minimum angle" means a smaller angle of angles formed by two straight lines.

Figure 15:
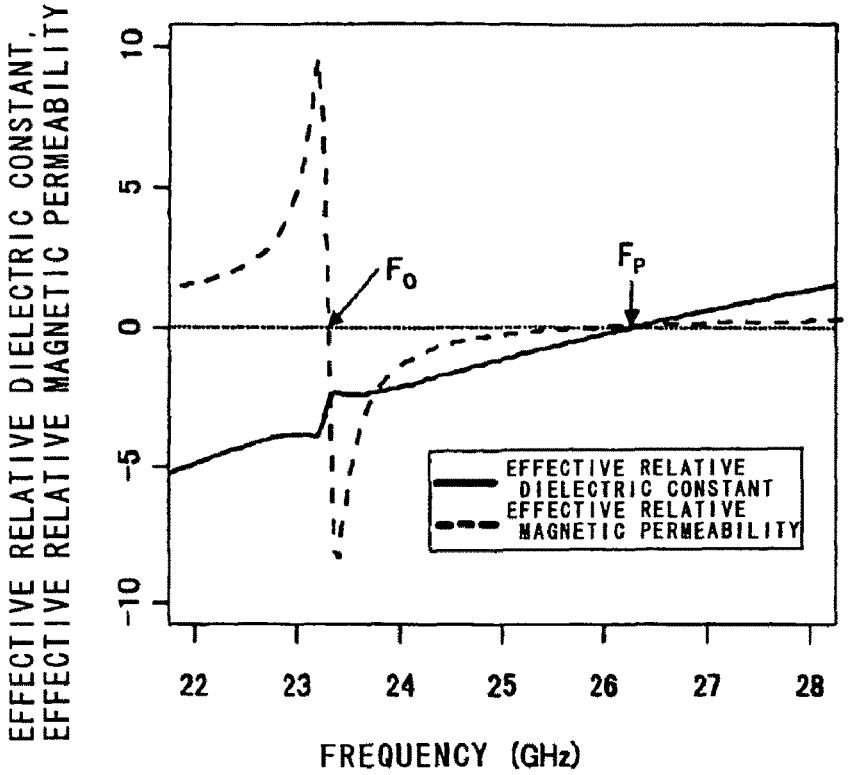
FIG. 15 is a graph showing frequency characteristics of an effective relative dielectric constant and an effective relative magnetic permeability in the second artificial medium.
Figure 16:
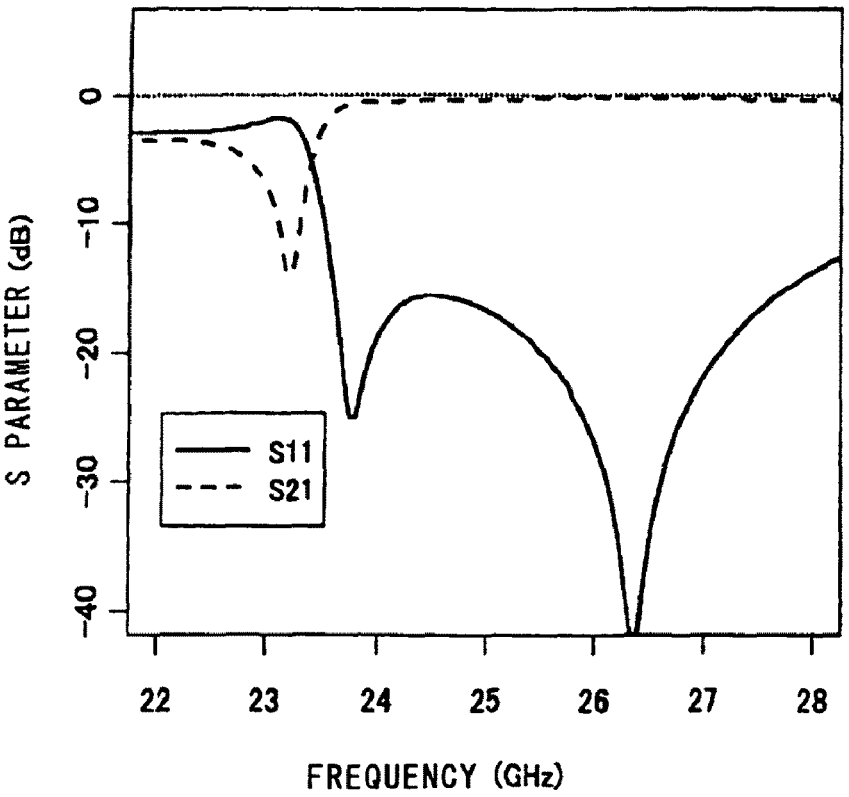
FIG. 16 is a graph showing frequency characteristics of an S parameter in the second artificial medium.

FIG. 15 and FIG. 16 show results obtained by calculating characteristics of the second artificial medium 200 by the above-described simulation method. FIG. 15 is a graph showing a dependence on frequency of an effective relative dielectric constant and an effective relative magnetic permeability of the artificial medium 200. FIG. 16 is a graph showing a dependence on frequency of parameters of S11 and S21 of the artificial medium. 200.

In simulations, the parameters used in the Table 2 are used. s designates the thickness of the dielectric layer and t designates the thickness of the grid lines (and the tiles) respectively. Further, a relative magnetic permeability of the dielectric layer 211 is set to 1.0 and a relative dielectric constant is set to 3.4.

TABLE 2

| | $P_X$ (mm) | $P_Y$ (mm) | $D_1$ (mm) | $D_2$ (mm) | $W_X$ (mm) | $W_Y$ (mm) | S (mm) | t (mm) |
|---|---|---|---|---|---|---|---|---|
| Second artificial medium 200 according to the present invention | 6.0 | 6.0 | 4.0 | 4.0 | 0.5 | 0.5 | 0.6 | 0.018 |

As apparent from the results of FIG. 15 and FIG. 16, also in the second artificial medium 200, a left-handed system medium is obtained in a wide frequency area of about 23 GHz to 26 GHz. Especially, as shown in FIG. 16, in the case of the second artificial medium 200, S21 is substantially 0 dB over a wide frequency area having a plasma frequency Fp (about 26.5 GHz) at a center. Accordingly, it is understood that the second artificial medium 200 obtains extremely good characteristics exceeding those of the first artificial medium.

In the second artificial medium 200, the good characteristics as described above are obtained owing to below-described reasons.

Ordinarily, a surge impedance Z is expressed by an equation of $Z=\sqrt{(\mu_0\mu_r/\epsilon_0\epsilon_r)}$. Here, $\mu_0$ designates a magnetic permeability of vacuum, $\mu_r$ designates a relative magnetic constant, $\epsilon_0$ designates a dielectric constant of vacuum and $\epsilon_r$ designates a relative dielectric constant. Here, ordinarily, the relative magnetic permeability changes so as to gradually increase relative to the frequency until the relative magnetic permeability converges to 1 under a frequency area higher than a magnetic plasma frequency (a frequency in which the relative magnetic permeability is 0) from a negative value under a frequency higher than a magnetic resonance frequency Fo. Accordingly, in order to match the surge impedance Z to a surge impedance in a free space, the frequency of the effective relative dielectric constant is preferably changed so as to come close to a gradient of the effective relative magnetic permeability to the frequency as much as possible.

On the other hand, as apparent from the comparison of FIG. 7 with FIG. 15, a gradient of the effective relative dielectric constant to the frequency in the vicinity of a plasma frequency Fp in the second artificial medium 200 comes closer to a gradient of the effective relative magnetic permeability to the frequency than a gradient in the first artificial medium 100. Therefore, the second artificial medium 200 can obtain a good impedance matching over a wider frequency area. Thus, the second artificial medium 200 can obtain better characteristics than those of the first artificial medium.

Further, the second artificial medium 200 has significant characteristics in view of a design as described below.

Figure 17:
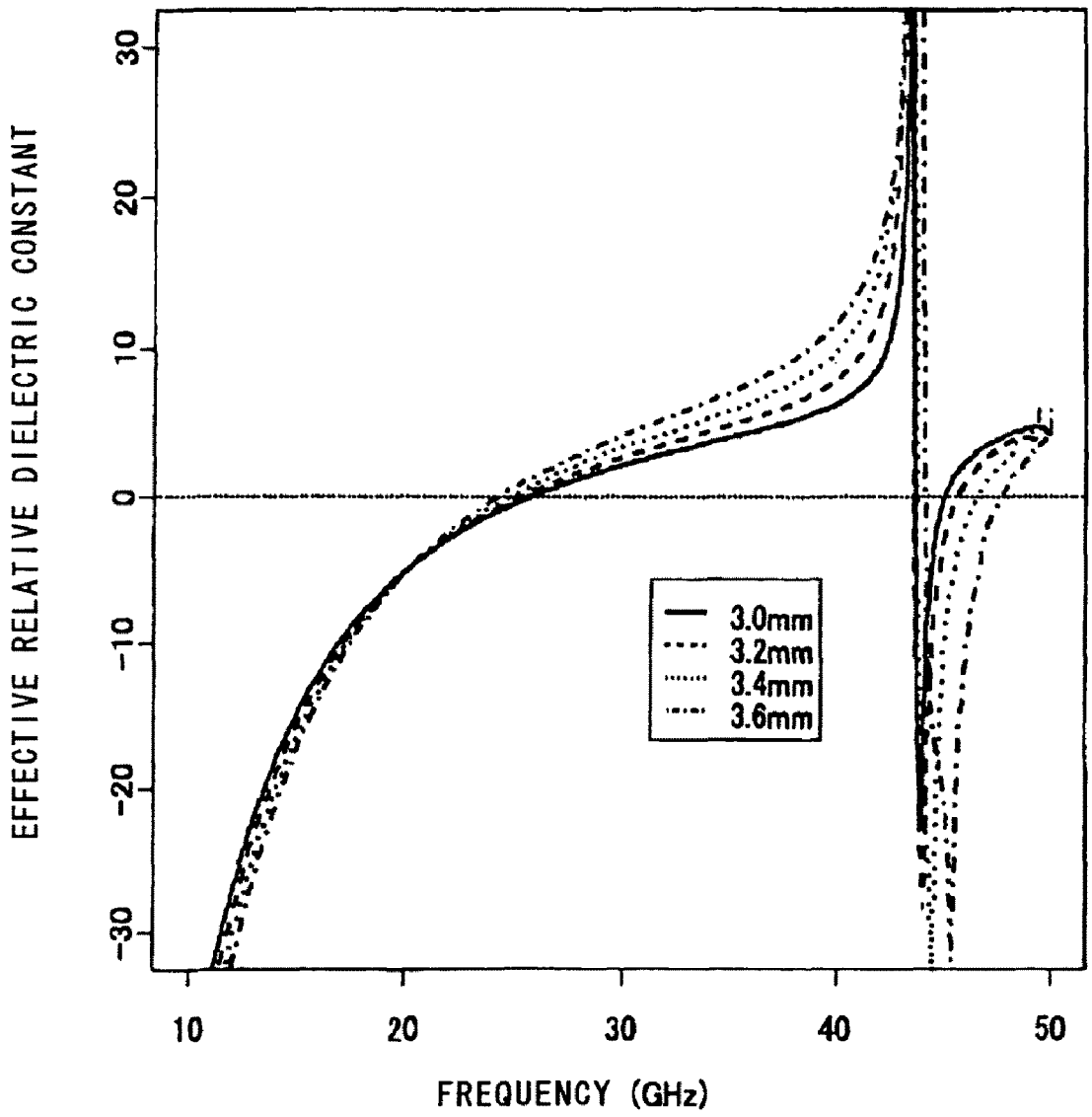
FIG. 17 is a graph showing the frequency characteristics of the effective relative dielectric constant when the dimension of a tile changes in the first artificial medium.
Figure 18:
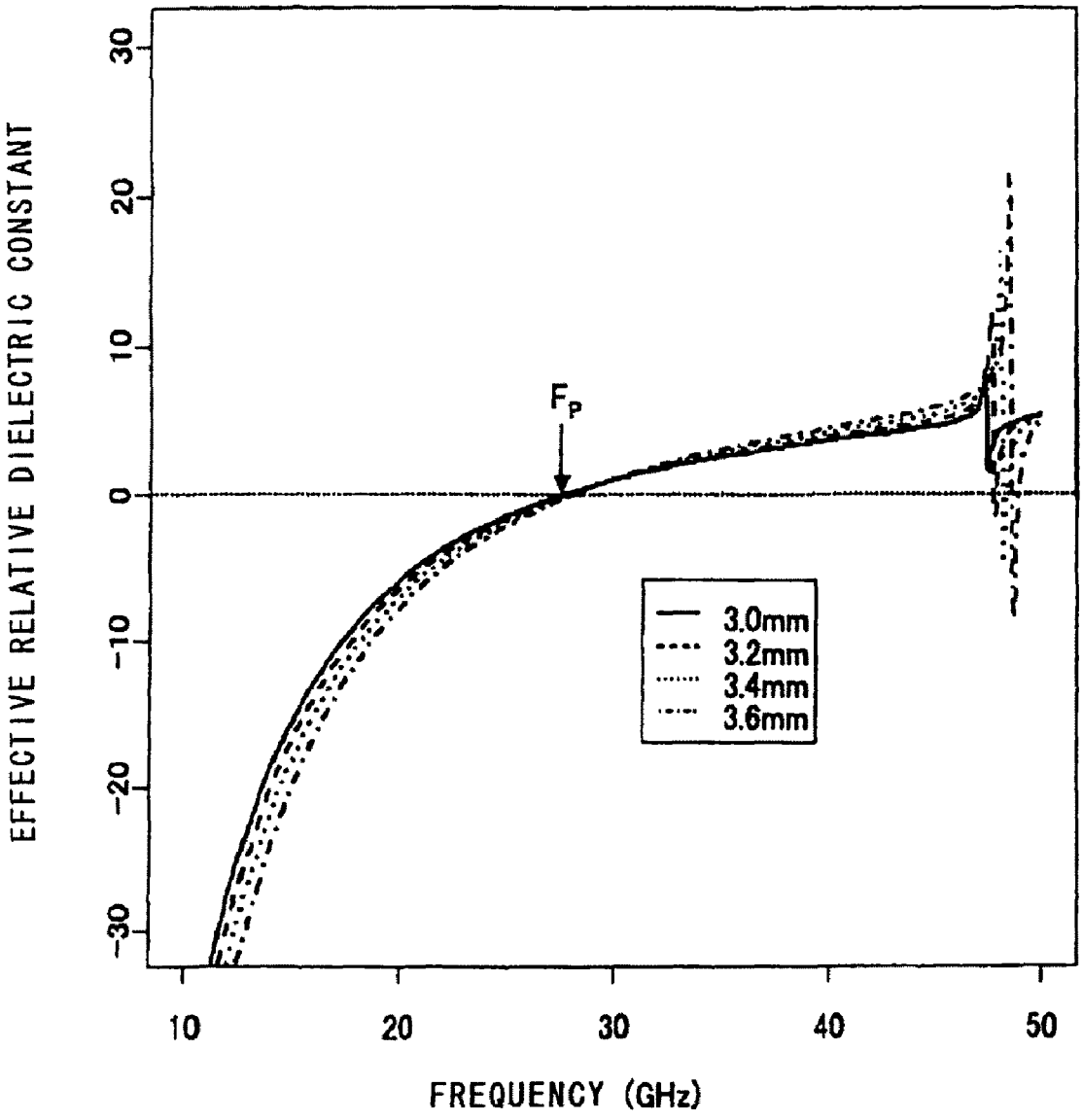
FIG. 18 is a graph showing the frequency characteristics of the effective relative dielectric constant when the dimension of a tile changes in the second artificial medium.

FIG. 17 is a graph showing the change of the effective relative dielectric constant of the artificial medium 100 when the dimensions $D_X$ and $D_Y$ of the tile obtained by using the above-described simulation method are changed from 3.0 mm to 3.6 mm. FIG. 18 is a graph showing the change of the effective relative dielectric constant of the artificial medium 200 when the dimensions $D_1$ and $D_2$ of the tile obtained by using the above-described simulation method are changed from 3.0 mm to 3.6 mm.

As can be understood from the comparison of both the figures, in the second artificial medium 200, the change of the form of the tile gives a smaller influence to the effective relative dielectric constant than in the first artificial medium 100. This matter may be considered as described below.

In the case of the first artificial medium 100, opposed sides are parallel to each other in the two adjacent tiles 140. Accordingly, in this case, a large electrostatic capacity is generated between the two adjacent tiles due to an electric charge concentrated in the end parts of the tiles 140. Therefore, in the first artificial medium 100, an electric field between the tiles is apt to be large. As compared therewith, in the case of the second artificial medium 200, opposed sides are not parallel to each other in the two adjacent tiles 240. Therefore, an electric charge is hardly accumulated in the end parts of the tiles 240, so that the electrostatic capacity is small between the two adjacent tiles 240. According to such a difference between both the artificial media, a difference depending on the form as described above is supposed to appear.

In FIG. 13, the tiles 240 are respectively formed in square shapes. However, when the opposed sides of the adjacent tiles are not parallel to each other, the tiles of the second artificial medium 200 of the present invention may respectively have any, forms. Further, sides forming an outline of the tile are not limited to straight lines and may be curved lines.

As described above, the second artificial medium 200 can obtain a further higher matching in the wide frequency area having the plasma frequency Fp as a center than the first artificial medium. Furthermore, in the second artificial medium 200, since the influence of a dimensional factor of the tile is low, a degree of freedom in design can be more increased.

When an incident polarized wave is rotated by 90° to carry out a simulation similarly to the above-described first artificial medium, a significant dependence on the polarized wave is not recognized in the second artificial medium.

Here, in the artificial medium of the present invention, at least one electrically conductive tile is preferably provided in each grid line.

Now, reasons of the above-described matter will be described below.

Figure 19:
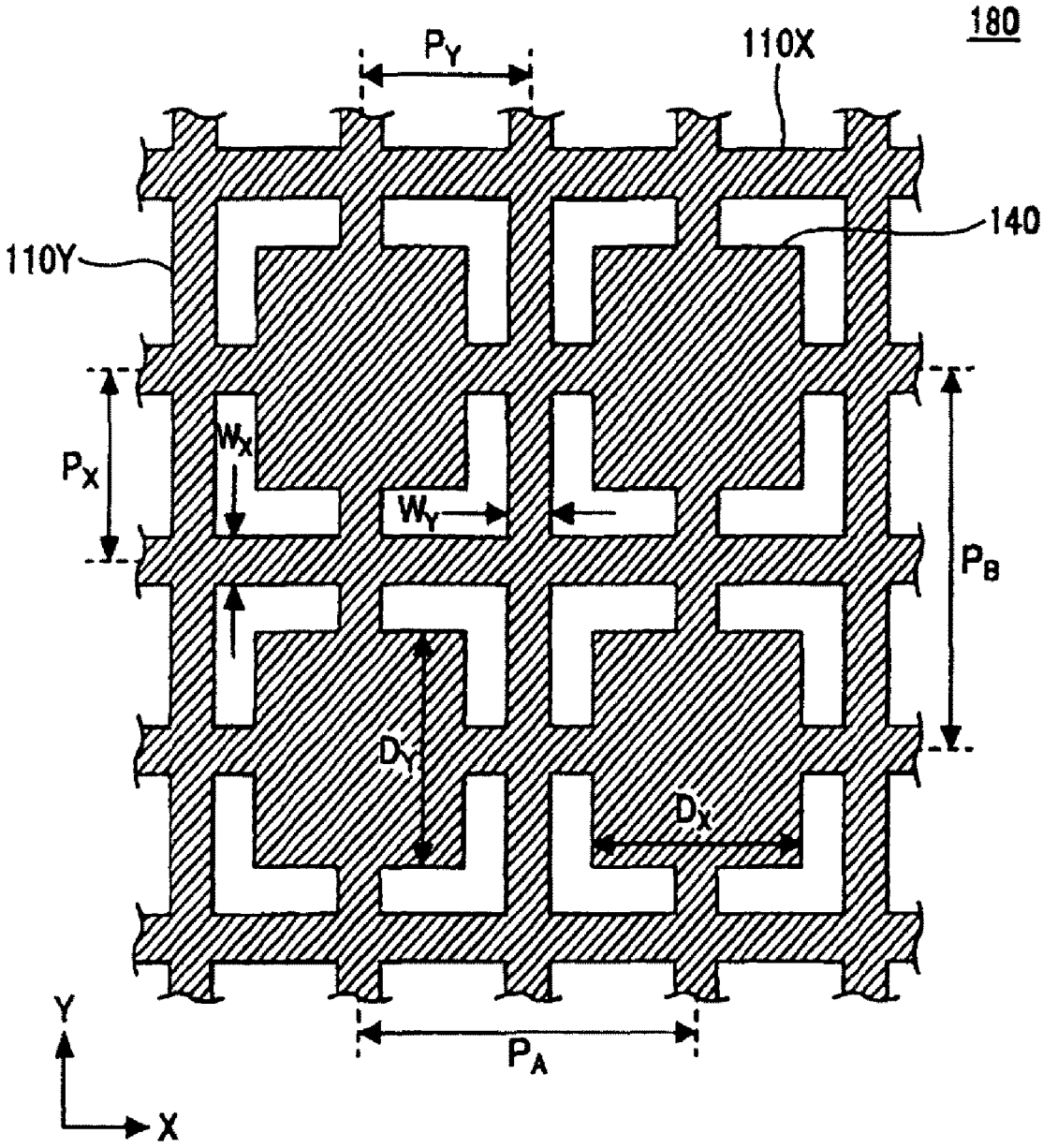
FIG. 19 is a schematic top enlarged view of another artificial medium 180 of the present invention.

For instance, an artificial medium 180 shown in FIG. 19 is considered. A pitch $P_X$ between first grid lines 110X of the artificial medium 180 is equal to a pitch $P_Y$ between second grid lines 110Y. Electrically conductive tiles 140 of the artificial medium 180 have an arrangement pitch $P_A$ in an X-direction and an arrangement pitch $P_B$ in a Y-direction. The pitches respectively have relations expressed by $P_A=2P_X$ and $P_B=2P_Y$. Peripheries of the electrically conductive tiles 140 of the artificial medium 180 are completely surrounded by the first and second grid lines. Namely, the electrically conductive tiles 140 of the artificial medium 180 may be considered to be arranged on both surfaces of a dielectric layer as, what is called "framed tiles". In other words, the artificial medium 180 shown in FIG. 19 has grid lines on which the electrically conductive tiles are not provided. Other structures of the artificial medium 180 are the same as those of the above-described artificial medium 100.

Results of a simulation of the artificial medium 180 constructed as described above are shown in FIG. 20 together with the results of the above-described artificial medium 100. In the simulation, the above-described FIT method is used. Further, parameter values of the artificial media 100 and 180 used in the simulation are respectively shown in Table 3. The thickness of the dielectric layer 111 is set to 0.6 mm, the dielectric constant of the dielectric layer 111 is set to 4.25 and a dielectric loss is set to 0.006. Further, the thickness (one surface) of a repeated pattern 105 is set to 18 μm.

TABLE 3

| | $P_X$ (mm) | $P_Y$ (mm) | $D_X$ (mm) | $D_Y$ (mm) | $W_X$ (mm) | $W_Y$ (mm) | $P_A$ (mm) | $P_B$ (mm) |
|---|---|---|---|---|---|---|---|---|
| artificial medium 100 | 6.0 | 6.0 | 4.0 | 4.0 | 0.8 | 0.8 | 6.0 | 6.0 |
| artificial medium 180 | 3.2 | 3.2 | 4.0 | 4.0 | 0.8 | 0.8 | 6.4 | 6.4 |

Figure 20:
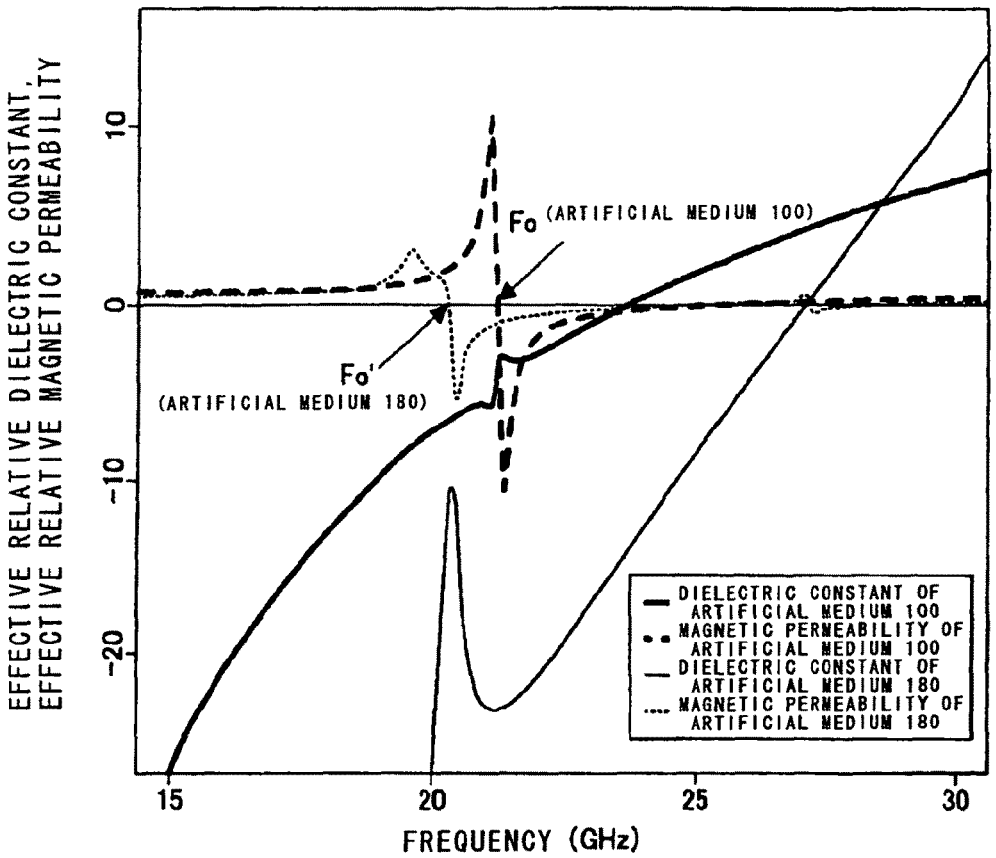
FIG. 20 is a graph showing the frequency change of an effective relative dielectric constant and an effective relative magnetic permeability of the artificial medium 180 shown in FIG. 19 and the result of the artificial medium 100 shown in FIG. 1.

As shown in FIG. 20, in the artificial medium 180, it is understood that an effective relative dielectric constant (a thin full line in the drawing) shows an outstanding peak in a frequency (about 20 GHz) in the vicinity of a magnetic resonance frequency Fo'. Further, accompanied therewith, in the artificial medium 180, a gradient of an effective relative dielectric constant to a frequency in a frequency area higher than the frequency Fo' (more specifically, an area of frequency of about 21 to about 25 GHz) is larger than a gradient of an effective relative magnetic permeability to a frequency. On the other hand, in the case of the first artificial medium 100, as shown in FIG. 20, in a frequency area after a magnetic resonance frequency Fo, a gradient of an effective relative dielectric constant (a thick full line in the drawing) to a frequency is substantially equal to a gradient of an effective relative magnetic permeability (a thick broken line in the drawing). In order to match a surge impedance Z, the gradient of the effective relative dielectric constant is preferably allowed to come close to the gradient of the effective relative magnetic permeability to the frequency as much as possible in the frequency area higher than the frequency Fo owing to the above-described reasons.

Accordingly, from such a viewpoint, the change of the effective relative dielectric constant of the artificial medium 100 is more preferable than that of the artificial medium 180.

Such a large peak of the relative effective dielectric constant as shown in FIG. 20 is similarly recognized even when the parameter values (for instance, the width $W_X$ and/or $W_Y$ of the grid line or the like) are respectively changed in the artificial medium in which patterns having what is called "framed tiles" are arranged.

According to the above-described things, it may be said that the intersections of the first grid lines and the second grid lines are preferably provided only on the electrically conductive tiles.

According to the above-described things, in the artificial medium of the present invention, at least one electrically conductive tile is preferably provided in each grid line.

Here, as for a method for producing the above-described artificial medium, when an actual production process is taken into consideration, the artificial medium may be preferably formed by a planar process, that is, by a method for laminating planes having characteristic patterns.

The above-described second artificial medium 200 is actually experimentally fabricated and its characteristics are evaluated. The artificial medium is formed by a below-described procedure.

Electrically conductive patterns including grid lines and tiles as shown in FIG. 13 are formed on front and back surfaces of a dielectric board (Mitsubishi Gas Chemical Co., Inc.) made of a BT resin. The electrically conductive patterns are formed with copper. Dimensions of elements are respectively shown in the columns of the second artificial medium 200 in the above-described Table 2. A relative magnetic permeability of a dielectric layer is 1.0 and a relative dielectric constant is 3.4.

The characteristics of the artificial medium are evaluated by a below-described method.

Figure 21:
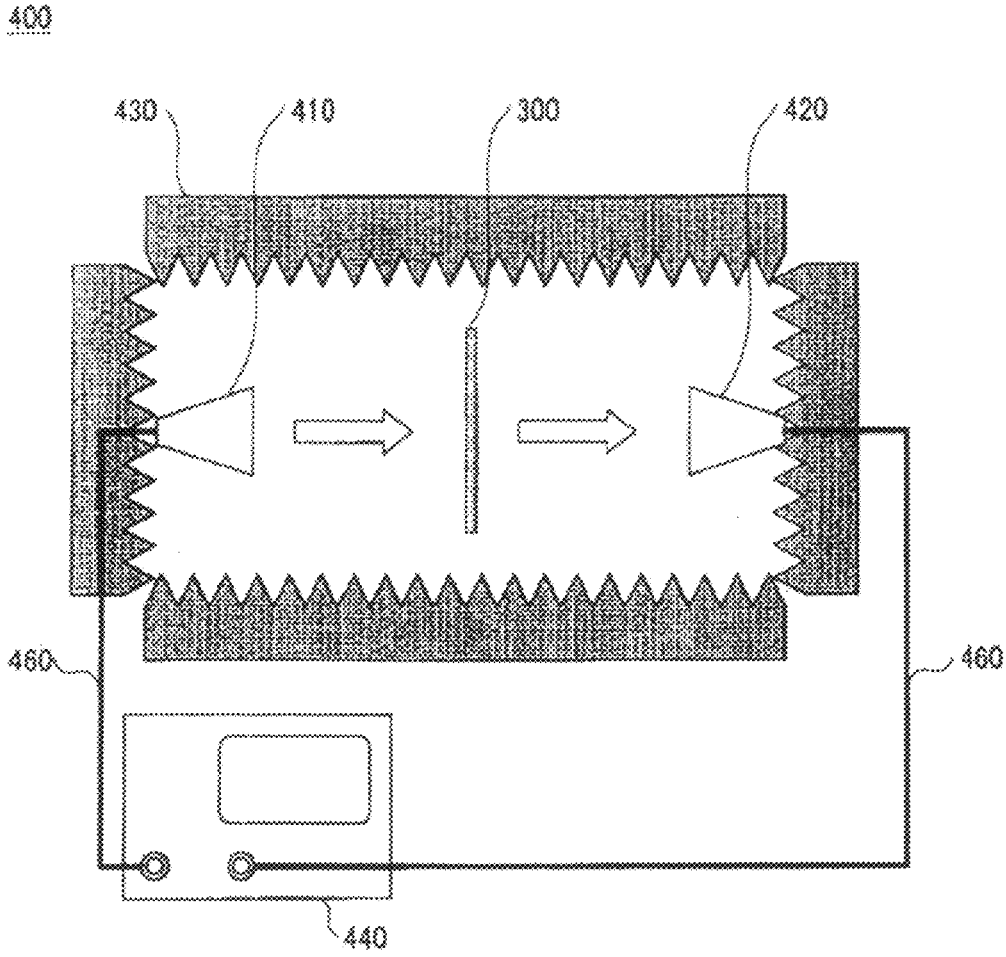
FIG. 21 is a schematic structural view of a measuring device for measuring characteristics of the artificial medium.

FIG. 21 shows a schematic structural view of a measuring device for measuring the characteristics of the artificial medium. The measuring device 400 includes a transmitting horn antenna 410, a receiving horn antenna 420, a radio wave absorber 430 and a vector network analyzer 440. Between the transmitting horn antenna 410 and the receiving horn antenna 420, the artificial medium 300 as an object to be measured that is fabricated as described above is installed. An entire measuring area from the transmitting horn antenna 410 to the receiving horn antenna 420 is covered with the radio wave absorber 430. Further, the vector network analyzer 440 is connected to the transmitting horn antenna 410 and the receiving horn antenna 420 through a coaxial cable 460. In this measurement, for the transmitting horn antenna 410 and the receiving horn antenna 420, a conical horn antenna is used. A distance from the transmitting horn antenna 410 to the receiving horn antenna 420 is set to 320.6 mm. A distance to the surface of the artificial medium 405 from the antennas 410 and 420 is set to 160 mm.

A relative dielectric constant and a relative magnetic permeability of the artificial medium are obtained in such a way as described below by using the above-described measuring device 400. Initially, by using the vector network analyzer 440, S parameters of the artificial medium 300 are measured in accordance with a free space method. Then, from the obtained result, the relative dielectric constant and the relative magnetic permeability of the artificial medium 300 are calculated by using a computational algorithm described in the following literatures (1) to (3).

(1) A. M. Nicolson, G. F. Ross, "Measurement of the Intrinsic Properties of Materials by Time Domain Techniques", IEEE Transaction on IM. No. 4, November, 1970

(2) W. B. Weir, "Automatic Measurement of Complex Dielectric Constant and Permeability at Microwave Frequencies", Proc. Of IEEE, Vol. 62, January, 1974

(3) J. B. Jarvis, E. J. Vanzura, "Improved Technique for Determining Complex Permittivity with the Transmission/Reflection Method", IEEE Transaction MTT, vol. 38, August, 1990

Figure 22A:
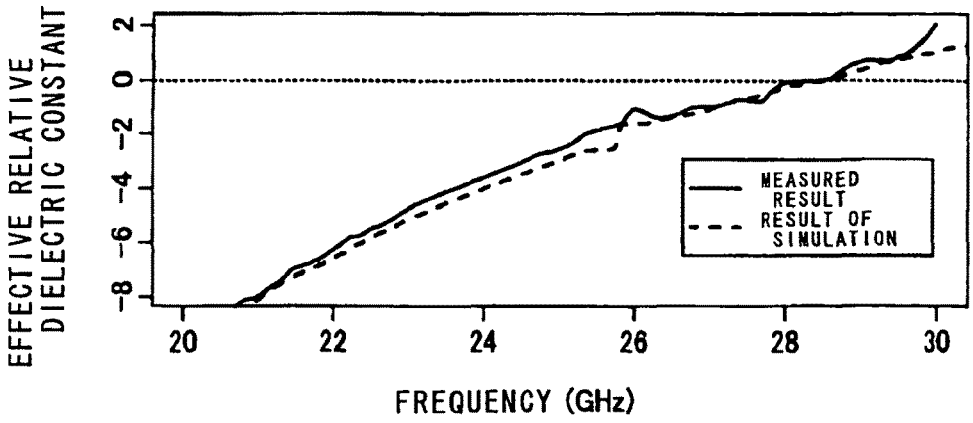
FIGS. 22A and 22B are graphs showing the frequency characteristics (actually measured values) of the effective relative dielectric constant and the effective relative magnetic permeability in the second artificial medium.
Figure 22B:
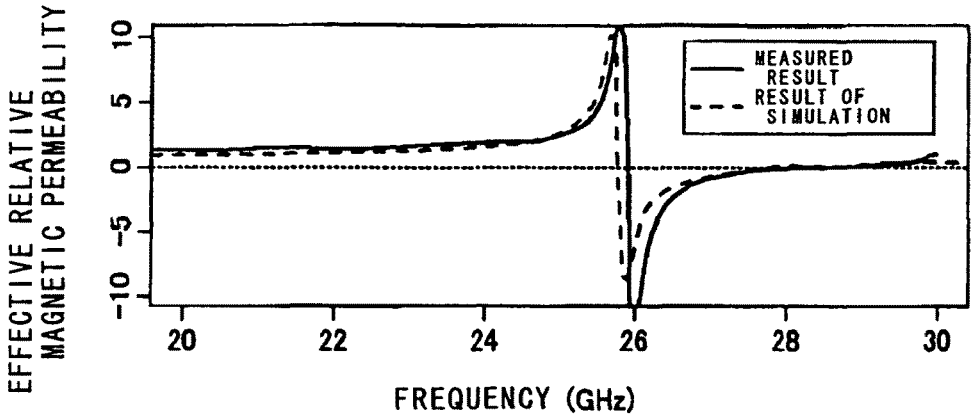
Figure 23A:
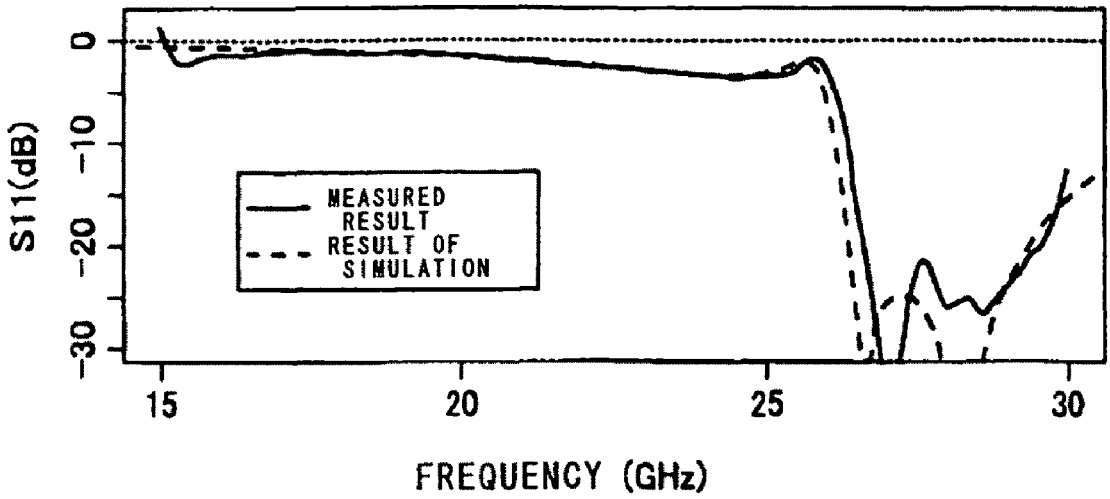
FIGS. 23A and 23B are graphs showing the frequency characteristics (actually measured values) of the S parameter in the second artificial medium.
Figure 23B:
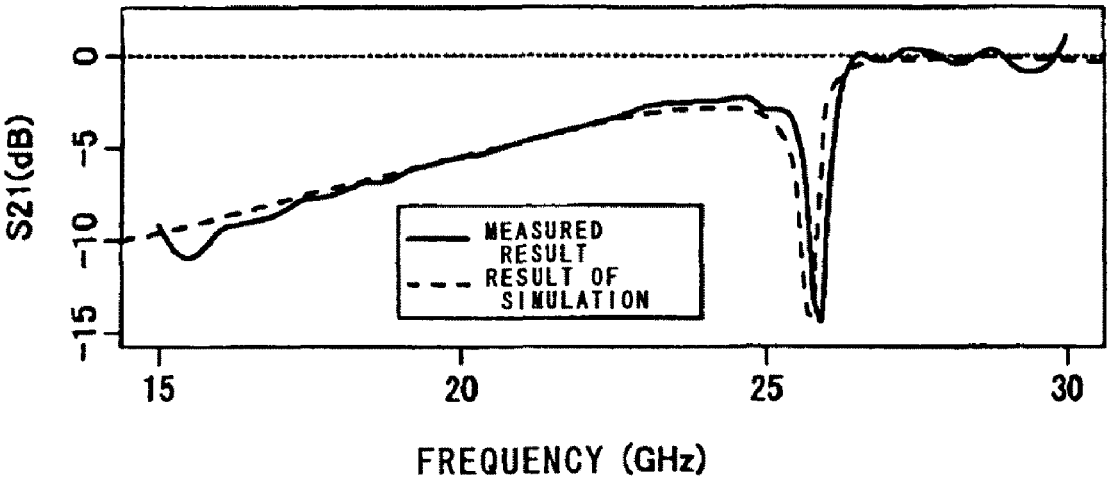

The obtained results are shown in FIGS. 22A, 22B, 23A and 23B. FIGS. 22A and 22B are graphs showing frequency characteristics of an effective relative dielectric constant (FIG. 22A) and an effective relative magnetic permeability (FIG. 22B). Further, FIGS. 23A and 23B are graphs showing frequency characteristics of an S1 parameter (FIG. 23A) and an S21 parameter (FIG. 23B). In FIGS. 22A, 22B, 23A and 23B, for the purpose of comparison, the calculated results (the results shown in FIG. 15 and FIG. 16) obtained by the above-described simulation are shown by broken lines.

As apparent from the drawings, also in the actually experimentally fabricated artificial medium, the same characteristics as the calculated results by the simulation are obtained. Namely, in the artificial medium according to the present invention, it is recognized that the characteristics having less loss over the wide frequency area are obtained.

The present invention is described in, detail by referring to the specific exemplary embodiment. However, it is to be understood to a person with ordinary skill in the art that various changes or modifications may be added without departing from the spirit and the scope of the present invention. This application is based on Japanese Patent Application (Japanese Patent Application No. 2008-045070) filed on Feb. 26, 2008 and the contents thereof is incorporated herein as a reference.

The invention claimed is:

1. An artificial medium comprising:

a dielectric layer having a front surface and a back surface;

a plurality of first grid lines respectively formed on the front surface and the back surface and extending in a first direction and a plurality of second grid lines extending in a second direction different from the first direction; and electrically conductive elements respectively formed on the front surface and the back surface of the dielectric layer and located in areas where one of the first grid lines intersect one of the second grid lines, wherein extending directions of the sides of the electrically conductive element are respectively different from the first and second directions; and wherein when an electromagnetic wave propagated in the direction of the thickness of the dielectric layer is incident, a current excited by the electromagnetic wave is increased in a prescribed operating frequency and a current loop is formed in a plane parallel to the direction of the thickness.

2. An artificial medium according to claim 1, wherein the first grid lines intersect orthogonally to the second grid lines.

3. An artificial medium according to claim 1, wherein the plurality of first grid lines and/or the plurality of second grid lines are arranged at intervals of the same pitches.

4. An artificial medium according to claim 3, wherein the plurality of first grid lines are arranged at intervals of the same pitches and the plurality of second grid lines are arranged at intervals of pitches equal to those of the plurality of first grid lines, and the electrically conductive elements are arranged at all parts where the first and second grid lines intersect and are not arranged at positions excluding the parts where the first and second grid lines intersect.

5. An artificial medium according to claim 1, wherein the forms and dimensions of the electrically conductive elements are substantially the same.

6. An artificial medium according to claim 5, wherein the electrically conductive element is rectangular or square.

7. An artificial medium according to claim 6, wherein the electrically conductive element is square.

8. An artificial medium according to claim 7, wherein the width of the first grid line is substantially equal to the width of the second grid line and a length of one side of the square shaped electrically conductive element is larger than the width of the first and second grid lines.

9. An artificial medium according to claim 7, wherein the first grid lines intersect orthogonally to the second grid lines and an minimum angle formed by the direction of each of sides of the electrically conductive element and the first direction is 45°.

10. An artificial medium according to claim 1, wherein the dielectric layer is laminated in the direction of the thickness.

11. An artificial medium comprising:

a dielectric layer having a front surface and a back surface;

a plurality of first electrically conductive elements that are formed on the front surface of the dielectric layer and mutually discretely arranged;

first grid lines formed on the front surface of the dielectric layer and extending in a first direction to connect together the plurality of first electrically conductive elements;

second grid lines formed on the front surface of the dielectric layer and extending in a second direction different from the first direction to connect together the plurality of first electrically conductive elements;

a plurality of second electrically conductive elements that are formed on the back surface of the dielectric layer and mutually discretely arranged so as to be symmetrical to the plurality of first electrically conductive elements formed on the front surface with respect to the dielectric layer;

third grid lines formed on the back surface of the dielectric layer and extending in the first direction to connect together the plurality of second electrically conductive elements so as to be symmetrical to the first grid lines formed on the front surface with respect to the dielectric layer; and fourth grid lines formed on the back surface of the dielectric layer and extending in the second direction to connect together the plurality of second electrically conductive elements so as to be symmetrical to the second grid lines formed on the front surface with respect to the dielectric layer, wherein when an electromagnetic wave propagated in the direction of the thickness of the dielectric layer is incident, a current excited by the electromagnetic wave is increased in a prescribed operating frequency and a current loop is formed in a plane parallel to the direction of the thickness; wherein extending directions of the sides of the electrically conductive elements are respectively different from the first and second directions.

* * * * *